US005502532A

United States Patent [19]

Biesinger et al.

[11] Patent Number: 5,502,532

[45] Date of Patent: Mar. 26, 1996

[54] METHOD AND SYSTEM FOR PROCESSING FILM BY SPEED AND ACTIVATING AGENT CONCENTRATION TEMPERATURE CONTROL

[76] Inventors: Mark G. Biesinger, 2481 Hartford St., Salt Lake City, Utah 84106; Matthew M. Biesinger, 1016 E. 900 South, Apt. #4, Salt Lake City, Utah 84105

[21] Appl. No.: 248,141

[22] Filed: May 23, 1994

[51] Int. Cl.[6] ..... G03D 13/00

[52] U.S. Cl. ..... 354/298; 354/299; 354/300

[58] Field of Search ..... 354/300, 298, 354/299; 355/100, 106; 219/388, 216

[56] References Cited

U.S. PATENT DOCUMENTS

| | | | |
|---|---|---|---|
| 3,585,917 | 6/1971 | Griffith | 219/216 |
| 3,774,520 | 11/1973 | Smith et al. | 355/100 X |
| 3,850,635 | 11/1974 | Leavitt | 96/48 |
| 4,052,732 | 10/1977 | Meadows | 354/297 |
| 4,105,323 | 8/1978 | Moraw et al. | 355/9 |
| 4,198,145 | 4/1980 | Scott | 354/83 |
| 4,275,959 | 6/1981 | Jones | 354/314 X |
| 4,354,095 | 10/1982 | de Vries | 219/388 |
| 4,371,246 | 2/1983 | Siryj | 354/299 |
| 4,485,294 | 11/1984 | Rosenberg | 219/388 X |
| 5,132,726 | 7/1992 | Yokota et al. | 355/100 |
| 5,166,724 | 11/1992 | Kobayashi et al. | 355/27 |

*Primary Examiner*—D. Rutledge
*Attorney, Agent, or Firm*—Workman, Nydegger & Seeley

[57] ABSTRACT

A system and method for processing heat-developed or chemically-developed photographic film. The heat-developed film is transported through a pair of driven heated rollers that are of different durometer that eliminate the curl in the film. The driven heated rollers preheat the film and transport it into a hot air chamber where the film is further heated to development temperature in an expansion free environment. The temperature of the preheat rollers and the hot air chamber are maintained within a predetermined set point range and the speed with which the film travels from the preheat rollers through the hot air chamber is progressively decreased with increasing length of the film being processed through the system. A similar method and system for controlling chemical activating agents concentration and speed of the photographic film being developed therethrough is also disclosed.

18 Claims, 12 Drawing Sheets

METHOD AND SYSTEM FOR PROCESSING FILM BY SPEED AND ACTIVATING AGENT CONCENTRATION TEMPERATURE CONTROL

A portion of the disclosure of this patent document contains material to which a claim of copyright protection is made. The copyright owner has no objection to the reproduction by anyone of the patent document or the patent disclosure as it appears in the Patent And Trademark Office patent file or records, but reserves all other rights with respect to the copyrighted work.

BACKGROUND OF THE INVENTION

1. Field of the Invention

This invention relates to the development of light exposed film and is more particularly related to a system and method which utilize an electronically monitored and controlled film developer to develop heat processed photographic emulsions film.

2. The Present State of the Art

Processes for the development of photographic film use sheets or webs of material that require the transport of a developing activating agent from a storage reservoir or point of generation of the photographic film to the surface of the sheet or web. The developing or activating agent is generally consumed or destroyed in the process, necessitating the replenishing or regeneration of these agents along with the continued transport to the sheet or web surface. The transport is typically in the form of chemical compounds that must diffuse through a liquid or gaseous carrier to the web or sheet surface where they react and are consumed. Another type of transport is the transfer of heat from a source through a solid, liquid, gas, or combination of media, not only to the surface, but through the sheet or web material. Heat is lost in the process as it is transferred to the sheet or web.

Rate limitations, in either the generation of the activating agent or transport from the point of generation or storage reservoir to the web, result in non-uniform processing from the beginning of the sheet or web to the end of the sheet or web. In the case of photographic film, the non-uniformity in processing is observed as a decrease in development of the photographic film and a consequent drop in development density of the film from the beginning of the sheet or web to the end of the sheet or web. In the case of large web lengths, the difference in density of development of the film can be significant and result in poor overall quality of the development of the film.

In order to reduce the effects of rate limitations of developing or activating agents on the photographic film and to reduce the resultant film development quality problems, there are several approaches and practices currently used. One such practice is maintaining large storage reservoir volumes or capacities of activating agent to compensate for the activating agent which is consumed during processing of the photographic film. Examples of such use are large chemical bath volumes for chemically reactive systems for chemically developed film, and massive heat sinks for the processing of thermally developed photographic film. The large volumes or capacities approach of such systems is effective in reducing the effects of rate limitations of generation or replenishing of the activating agent. However, such large chemical reservoirs and heat sinks are costly both to operate and to store. Thus, it is desirable to find a system that would solve the present problem of quality of development density of the photographic film without incurring a large cost to do so.

Another problem with large storage reservoir volumes or capacities of activating agents is that this solution fails to address the limitations caused by transfer rate or transport in that there is no true regulation of the amount of activating agent being applied to the photographic film. Thus, a control problem exists in the development of the photographic film for both chemically activated systems and for thermally activated systems.

Another method used to reduce the effects of rate limitations and the resultant development density quality problems is incorporated into systems which add additional activating agent during the film development process. This approach could be the addition of chemical compounds or heat, depending on whether the system is a chemically developed photographic film system or a thermally developed photographic film system. With this type of compensating method, limitations on generation and replenishing of the activating agents are addressed, and by adding activating agent in excess of the actual usage rate, compensation can also be made for transport limitations. The transport rate from the storage reservoir to the sheet or web of photographic film is increased as a result of the larger activating agent driving force generated by the higher temperature or chemical concentration. The problem with this method is that it is difficult to control the activating agent being applied to the photographic film and thus requires adjustment of the temperature or chemical concentration of the activating agent after processing of each photographic film web or sheet in order to establish constant initial starting points and to maintain consistent results between processing successive batches of photographic film. Thus, it is desirable to develop a system which is able to control the amount and degree of activating agent that is applied to a photographic film, while minimizing shortages of such activating agent or excesses of such activating agent being applied to the photographic film during the film development process.

A particular problem exists with heat developed type photographic emulsions film in that this type of film is difficult to process and requires close temperature tolerances in its development. When the heat developed film reaches the development temperature, i.e., 240°–300° F., the emulsion side of the heat developed film becomes very soft and will stick to most surfaces in contact therewith. The soft emulsion side of the heat developed film makes it difficult to transport through a photographic film processor without some physical transport contact with the emulsion side of the heat developed film. Any such contact with the emulsion side of the heat developed film during the development process when the emulsion side is soft will leave a signature or imprint from such contact in the emulsion side of the heat developed film. Alternatively, such contact with the emulsion side of the heat processed film could transfer the emulsion to the object that came in contact with the emulsion side of the film.

Another problem with heat developed type film is that the sheet or web of the film tends to wrinkle or curl during film development.

A still further problem with heat developed type film involves processors for dry silver film. Processors for developing dry silver film may include electrostatic drums wherein the dry silver film is given an electrostatic charge, causing the dry silver film to cling to the electrostatic drum on a base side of the film which is opposite to the emulsion side of the film. With this system, the emulsion side of the film is not touched which gives the benefit of solving the aforementioned two problems related to contacting the emulsion side of the dry silver film. However, any small particles of dust on the electrostatic drums or on the base side of the dry silver film will isolate the dry silver film from the heat and thus cause an underdevelopment of the film in such areas of isolation.

A further problem with electrostatic drum processes is that the contact between the base side of the dry silver film and the electrostatic drums is not perfect and such imperfection causes pockets of air therebetween. The pockets of air further cause blotches of undeveloped dry silver film. When the dry silver film is stiff with a stable base side, the dry silver film will not cling to the electrostatic drums, and the larger sizes of dry silver film will tend to buckle and wrinkle so as to make the electrostatic drum method of processing the dry silver film undesirable for developing such stiff and stable base or larger sizes of dry silver film. Examples of such stiff, stable base dry silver film and larger size dry silver film are laser imaging films which are provided in large formats.

Flock roller processors also are used and work fairly well with paper products and certain types of thermally processed film that have a hard coating applied on top of the emulsion side of the film when the film is manufactured.

Flock roller processors, however, will not develop film that has a hard coating applied on top of the emulsion side of the film. The hard coating slows the exposure speed of the film, adds to the expense of making the film, and causes other exposure problems in modern laser imaging. Additionally, the flocked rollers shed fibers and particles and also have the detriment of becoming brittle and rough due to the presence of a stationary bar heater accompanying the flocked rollers which both heats and drags on the flock rollers.

BRIEF SUMMARY AND OBJECTS OF THE INVENTION

The system, apparatus and method of the present invention have been developed in response to the present state of the art and, in particular, in response to the problems and needs in the art not heretofore fully or completely solved by the conventional film developing processes used in connection with chemical or thermally developed film procedures. It is not intended that the system, method and apparatus of the present invention will be necessarily limited solely to thermally or chemically developed film development procedures disclosed in the figures herein, since they will also find useful application with potentially many kinds of procedures requiring the utilization of heat or chemical concentration control with film speed maintenance for various types of film development procedures. Thus, it is an overall objective of the present invention to provide a system, a method, and an apparatus which provide for more accurate development of film in which a controlled dispensing of an activating agent is provided in communication with photographic film for the development of same, where the control of the rate of travel of the film through the film development system is also provided.

It is a further object of the present invention to provide a developer for thermally processed film having an emulsion side and an opposite base side, where the emulsion side is heated to a point of softness out of contact with any object, and where the heat activating agent is evenly applied and controlled to the emulsion side of the film so as to provide an even quality of development from the beginning of the web of film to the end of the web of film. It is also an object of the invention to provide a means for preheating a thermally developed film prior to heating the film to a development temperature so as to shorten the total throughput time for developing the thermally developed film.

It is yet another object of the invention to provide a thermal film processor that provides protection against wrinkling and curling of a web of thermally developed film.

It is a still further object of the invention to build a thermal film processor which is numerically controlled and operated and requires a minimal heat sink and minimal electrical power to heat the heat sink so as to minimize the cost of building and operating the thermal film developer system.

Another important object of the present invention is to provide a system, method and an apparatus whereby state of the art electronic technology can be used to develop photographic film.

These and other objects and features of the present invention will become more fully apparent from the following more detailed description taken in conjunction with the drawings and claims, or may be learned by practice in the invention.

Briefly summarized, the foregoing and other objects are achieved in an electronically monitored and controlled photographic film processor. The disclosed method is to continuously vary the speed of the sheet or web of photographic film as it passes through the processor and the activating agent therein. The activating agent is maintained within a set concentration range. The change in speed of the web as it passes through the processing step of combining the web with the activating agent compensates for the rate limitations by gradually changing the retention times of the web as the web proceeds through the processor. The gradual changing retention times counteract the degradation or loss of activating agent in contact with the photographic film so as to provide for more uniform developing of the film.

The invention contemplates that the speed change can be linear, exponential, or follow a polynomial relationship. The selection of speed change form is dependent on the specific application and characteristics of the rate-limiting step. For example, if the rate limitation for uniform processing is the transfer of convective or conductive heat, the speed change would be linear since the transfer of heat by these mechanisms is linear with the temperature differential. If the rate limitation is the chemical reaction rate, and the particular reaction kinetics is second order, the speed change would follow a nonlinear or quadratic function.

In some applications, the method would involve reducing the speed of the web or sheet as it proceeds through the photographic film processor. The speed would be highest at the beginning of the processing and would continuously decline by some predetermined rate and function. The initiation of the speed change could start at the beginning of processing or could be delayed. The combination of speed change rate, function of speed change, and timing for implementing the speed change, can be determined by mathematical modeling for a specific application.

In some cases, it may be desirable to increase the speed as the web or sheet of photographic film is processed, as in the case of exothermic reactions where heat is generated, and the rate of reaction during processing increases as opposed to decreases. Thus, the method of controlling the speed rate of the film through the activating agent is adaptable for endothermic, isothermic, and exothermic reactions between the film and the activating agent during development.

The method of the present invention allows for a speed change which is simple to implement, monitor and control so as to allow for processing accuracy of the photographic film. Monitoring of the web or sheet of photographic film as it is fed through the film developer by a positive means enables a rapid response to various control variables. Thus, successive batches of photographic film may be developed without a delay. For example, the speed and temperature at which the photographic film is initially fed through the processor can be immediately reset between each successive batch of photographic film.

The system of the present invention achieves the foregoing and other objects for the processing of thermally developed film with base and emulsion sides by providing an electronically controlled pair of driver rollers. The driver rollers are driven by a computer controlled stepper motor. The output of the stepper motor can be varied by the number of pulses per second sent to the motor, which pulses are determined by data that can be within a software program. The driver rollers are heated so as to provide a predetermined preheating temperature below the development temperature of the film. The pair of driver rollers have one hard driver roller and a softer driver roller. The softer driver roller contacts the emulsion side of the film while the hard driver roller contacts the base side of the film.

The film proceeds from the driver rollers under gravity feed once the film has been heated to the predetermined preheating temperature. The film then moves under gravity feed into a development compartment which is heated by a series of metallic bars providing a heat sink for transferring thermal energy to the film. As the film travels through the development compartment, it is heated to the development temperature during which no contact is made between the film in the development compartment and any other surface. In order to make homogenized the temperature within the development compartment, a series of soft foam rollers rotate in the direction of the film travel so as to circulate the air in the development compartment and to impinge an air curtain on both sides of the film.

After leaving the development compartment, the film moves into a cooling compartment under gravity feed where the temperature of the film is lowered substantially below the temperature development of the film. A film guide contacts the base side of the film and distributes the film in a film storage compartment below the cooling compartment which is accessible to a system user to remove the processed film.

The system also comprises a display means for outputting a visual display of the status of the thermal film processor to a system user to determine whether the film web is being processed, whether the processor is ready to process another web of film, or whether the processor is not yet ready to receive another web of film.

The electronic control system used in conjunction with the system and method of the present invention may also be optionally designed to permit the selection and input of various control parameters such as a film development temperature range, a film preheat temperature range, maximum and minimum velocities at which the stepper motor moves the film, and a time period during which the stepper motor will move the film at its initial maximum velocity. The electronic control system is controlled by digitally processed software contained in a software program. As the program changes the frequency of electrical pulses to the stepper motor, the speed of the pair of driver rollers changes which also changes the throughput speed of the film through the thermal processor.

The initiation of the speed change can occur at the beginning of film processing, or can be delayed to begin at a preset time where the speed of the film will begin to change through the thermal processor after it has traveled at a constant speed for the preset period of time. The speed change in the case of the thermal processor is linearly decreasing and is accomplished by decrementing the number of electrical pulses per second sent to the stepper motor. The source code for the program for decrementing the speed of the stepper motor, and for controlling the temperature of the preheat rollers and the development compartment heaters is processed in conjunction with a programmable logic controller (PLC) which implements the method of the present invention.

In the case of chemically developed film, the film is fed from a film storage device into a vat of chemical activating agent. As in the thermally developed film, the speed of a stepper motor is controlled so as to decrease the rate of travel of the film through the vat of chemical activating agent as the length of the web that has been processed increases. The electronic control system used in conjunction with the system and method of the present invention for processing chemically developed film controls the speed of a stepper motor that draws the film through the vat of chemical activating agent, and also controls the introduction of chemical activating agent into the vat so as to maintain the concentration of the chemical activating agent within a predetermined concentration range.

As in the thermally developed film processing systems, the chemically processed film systems have a controller for executing a program having a source code for decrementing the speed of the stepper motor and for controlling the concentration of activating agent being added to the vat of activating agent. Also, the software for such control is processed in conjunction with a programmable logic controller which implements the method of the present invention.

The system and method disclosed herein are thus efficient and easy to operate while at the same time providing improved convenience and accurate film development density for both thermally and chemically developed photographic film.

BRIEF DESCRIPTION OF THE DRAWINGS

Presently preferred embodiments in the presently understood best mode of the invention will be described with additional detail through use of the accompanying drawings, wherein corresponding parts are designated by the same reference numerals throughout and in which.

DETAILED DESCRIPTION OF THE PRESENTLY PREFERRED EMBODIMENTS

The following detailed description is divided into three parts. In Part I, the overall system of a thermally developed film processor is described, including a description of the preheat compartment, the development compartment, and the electronic control circuitry which are referred to in FIGS. 1 through 5B. In Part II, the preferred method is presented by which the system of the present invention is used to electronically control the heating of the thermally processed photographic film and to control the speed with which the film travels through the expansion free thermal processor, including a detailed description of one presently preferred method for programming the CPUs used in the electronic circuitry by reference to FIG. 6. In Part III, the preferred method and system for electronically controlled processing of chemically developed film is presented.

I. THE SYSTEM

A. General Environment and Intended Utility of the System

As noted above, the system and method of the present invention have been developed in response to specific needs which have been found to exist in connection with techniques that are currently in use according to the present state of art which have been developed in connection with procedures for processing thermally developed film.

DETAILED DESCRIPTION OF THE DRAWINGS

Reference is now made to FIGS. 1–5B as examples of the inventive film processing system.

Figure 1:
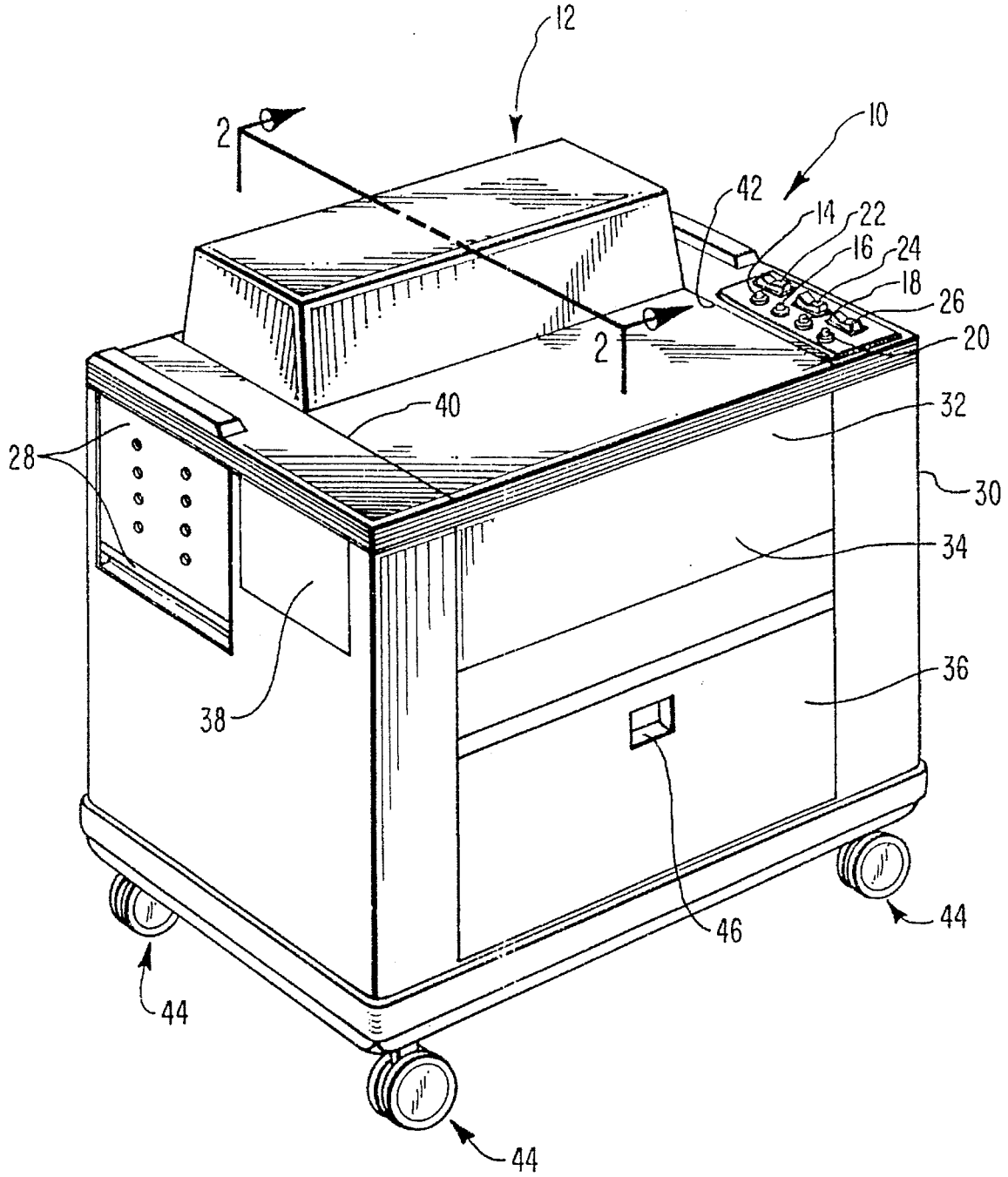
FIG. 1 is a perspective illustration showing the system of the present invention and, in particular, illustrating a film cassette mounted on top of an expansion free thermal processor, which processor is mounted upon casters so as to be mobile.

FIG. 1 shows a preferred embodiment of an inventive expansion free thermal processor 10. A film cassette 12 is placed on top of expansion free thermal processor 10 so as to feed the thermally processed film into expansion free thermal processor 10. A series of lights 14, 16, 18, 20, and a series of switches 22, 24, 26 comprise a control panel for use by a system user to operate expansion free thermal processor 10. Light 14 is the ready light indicating that the system is properly functioning and is ready to begin processing film. Light 16 is the processing film light indicating that film is currently being processed through expansion free thermal processor 10. Light 18 is the processing complete light which indicates that film has been processed through expansion free thermal processor 10. Light 20 is the not ready light indicating that the system is not yet ready to begin processing film.

A ventilation system 28 is depicted on FIG. 1 which shows a series of holes through which air may be communicated to the internal compartments of expansion free thermal processor 10. As described hereinafter, electrical fans can be used to draw air into expansion free thermal processor 10. Various compartments for developing the thermally processed film are contained within a film processor cabinet 30. Film processor cabinet 30 has a film preheating compartment cabinet 32, a film development compartment cabinet 34, and a processed film compartment cabinet 36.

An electronic access cover 38 serves as a doorway through which access can be gained to various electronic components of expansion free thermal processor 10. Film cassette 12 is placed within two cassette guides 40, 42 in order to load and begin processing of the thermally developed film. Film processor cabinet 30 can be mobile in order to facilitate use of expansion free thermal processor 10 in a variety of locations. In order to enable such mobility, casters 44 can be placed on the bottom of film processor cabinet 30. Access to film that has been processed by expansion free thermal processor 10 can be gained via drawer latch 46.

Figure 2:
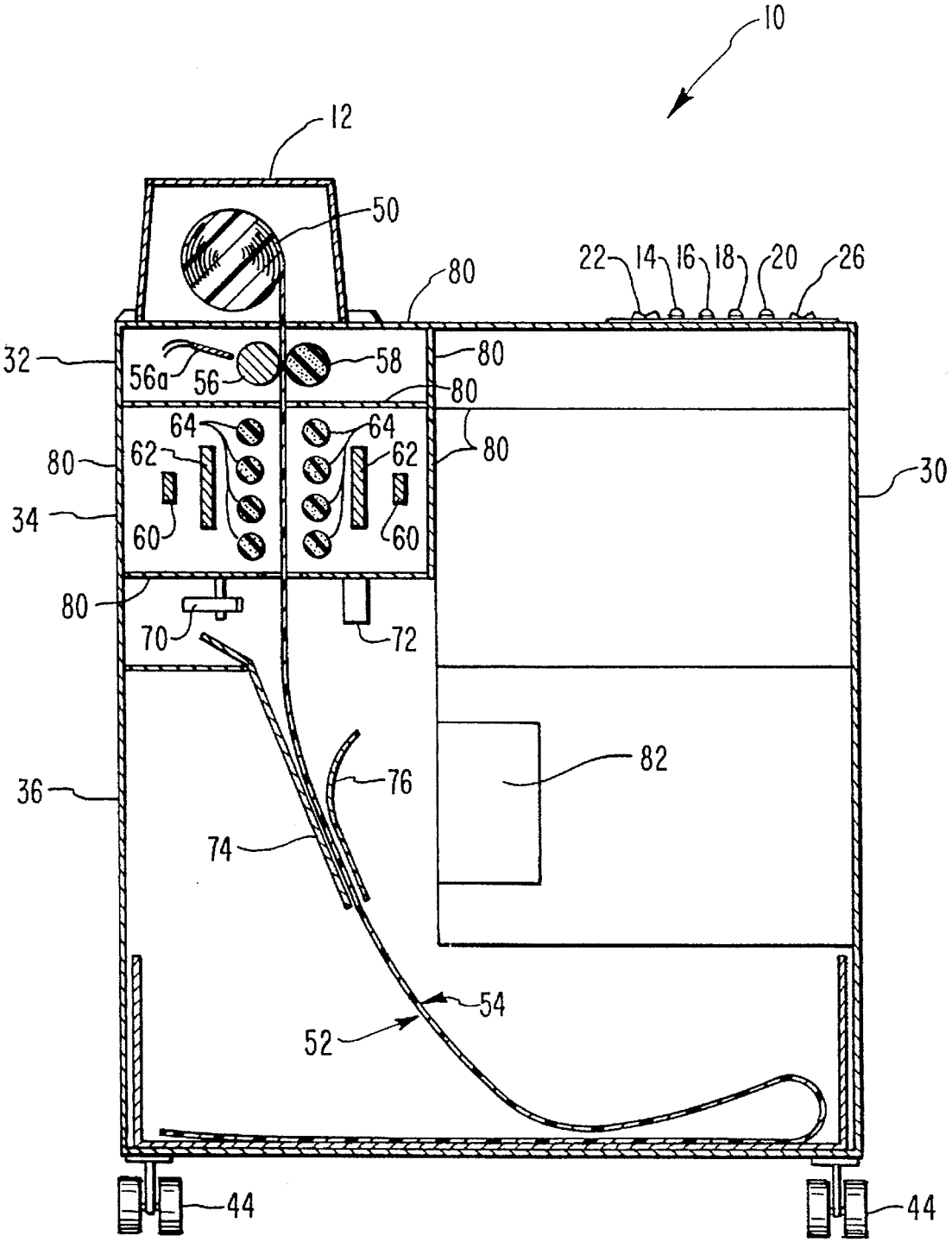
FIG. 2 is a cross-sectional view of the expansion free thermal processor and film cassette that more particularly illustrates the process of developing thermal photographic film in which the film moves from the cassette through a preheating compartment having therein a pair of preheating rollers with a nip therebetween, and into a heating compartment at which the temperature of the film is brought up to the development temperature for the thermal photographic film, the film passing from the development compartment past an electronic ultrasonic sensor into a cooling compartment where the path of the film is guided by a film guide.

FIG. 2 shows a variety of the internal components of expansion free thermal processor 10. Particularly, a dry silver film 50 is shown being paid out of film cassette 12. Dry silver film 50 has a base side 52 and an emulsion side 54. Film 50 is fed into a nip between a drive roller 56 and a soft roller 58. Drive roller 56 is a driven roll having a hard surface and soft roller 58 is a non-driven roll having a soft surface. Soft roller 58 comes in contact with emulsion side 54 of dry silver film 50. Drive roller 56 comes in contact with base side 52 of dry silver film 50. A drive roller temperature sensor 56a is in contact with or juxtaposed to drive roller 56 for detecting the temperature thereof. Drive roller 56, drive roller temperature sensor 56A, and soft roller 58 are located in film preheating compartment cabinet 32.

Film development compartment cabinet 34 contains a variety of metallic bars for heating dry silver film 50. Main heater bars 60 are situated symmetrically on either side of dry silver film 50. Trim heater bars 62 are also located symmetrically on either side of dry silver film 50. A series of four foam rollers 64 are symmetrically located on either side of dry silver film 50. Foam rollers 64 rotate clockwise on the left-hand side of FIG. 2 and rotate counterclockwise on the right-hand side of FIG. 2 so as to create an air current within film development compartment cabinet 34 and so as to create air impingement upon the surface of both base side 52 of dry silver film 50 as well as on emulsion side 54 of dry silver film 50. Further, foam rollers 64 enable a homogenous isothermal condition within film development compartment cabinet 34.

Dry silver film 50 passes vertically downward under the force of gravity through film development compartment cabinet 34 from film preheating compartment cabinet 32. After having passed from an entrance of film development compartment cabinet 34 to an exit of film development compartment cabinet 34, dry silver film 50 passes into any entrance of processed film compartment cabinet 36 where dry silver film 50 cools.

Within processed film compartment cabinet 36, an ultrasonic gun 70 and an ultrasonic target 72 detects the presence of dry silver film 50 when dry silver film 50 breaks in between the ultrasonic pathway between ultrasonic gun 70 and ultrasonic target 72.

Dry silver film 50 is cooled down from the temperature achieved within film development compartment cabinet 34 while dry silver film 50 is within processed film compartment cabinet 36. The temperature achieved within film development compartment cabinet 34 is such that the emulsion side 54 of dry silver film 50 undergoes a change brought on by the increased temperature therein such that dry silver film 50 develops a previously imposed image thereon. When dry silver film 50 enters processed film compartment cabinet 36, the temperature of dry silver film 50 begins to decrease. During the decrease of temperature of dry silver film 50, emulsion side 54 of dry silver film 50 remains out of contact with any surface. Two film guides 74, 76 are located within processed film compartment cabinet 36 and are oriented so as to avoid contact with emulsion side 54 of dry silver film 50 during the cooling thereof. By the time that dry silver film 50 is lowered to the lowest point of processed film compartment cabinet 36, emulsion side 54 of dry silver film 50 is cool enough that it may contact other surfaces without affecting the development of dry silver film 50.

In order to develop dry silver film 50 within the various compartment cabinets 32, 34, 36, it is desirable to maintain close temperature tolerances. In order to achieve such temperature tolerances, various thermally insulated walls 80 are located within film processor cabinet 30.

An electronics cabinet 82 is located within film processor cabinet 30 for the purpose of storing therein electronic components necessary to control expansion-free thermal processor 10.

Figure 3:
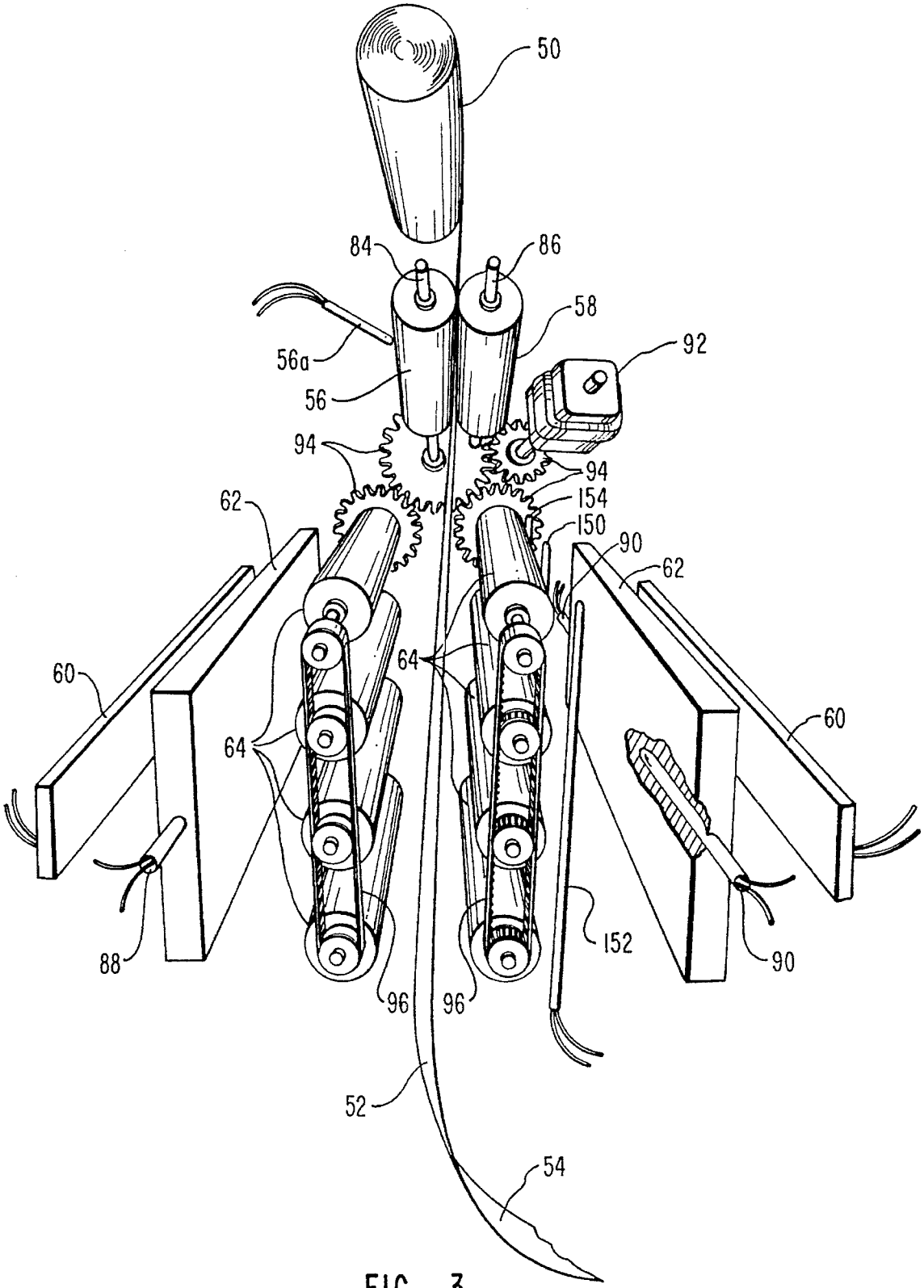
FIG. 3 is a perspective illustration showing the drive train system for moving the film from the film cassette through the preheater rollers and past a series of heating plates. Also illustrated in FIG. 3 are temperature sensors for sensing the environment in which the film is being heated, both at the preheat rollers and in the heating compartment. The drive train also drives a pair of four-roller sets of soft foam rollers which circulate air throughout the heating compartment.

FIG. 3 depicts the mechanical means by which dry silver film 50 is fed and is heated within expansion-free thermal processor 10. Dry silver film 50 is fed into a nip between drive roller 56 and soft roller 58, which are respectively heated by a drive roller heater 84 and a soft roller heater 86. Roller heaters 84, 86 radiate heat respectively through rollers 56, 58 so as to heat dry silver film 50 at the nip therebetween. The temperature to which dry silver film 50 is heated by rollers 56, 58 is detected by drive roller temperature sensor 56*a* which is in contact with or juxtaposed to drive roller 56.

Drive roller 56 is rotated about an axle therethrough upon which is journaled a gear driven by a main driving gear that is rotationally moved by a stepper motor 92. A series of drive train gears 94 coordinate one with another to rotate drive roller 56 as well as two sets of four foam rollers 64. The first roller of each set of four foam rollers 64 has a drive train gear 94 at one end and a drive belt 96 at the other end thereof. Each of the rollers in the set of four foam rollers 64 is driven by drive belt 96. Trim heater bars 62, of which there is a left trim heater bar 62 and a right trim heater bar 62, are respectively heated by a left trim heater 88 and a right trim heater 90. Left trim heater bar 62 has two tapped holes into which are respectively placed one resistance heater 88 for the purpose of heating left heater bar 62. A similar arrangement is made for right heater bar 62 which also has first and second holes tapped into which first and second resistant heaters 90 are placed. Thus, left and right heater bars 62 are heated respectively by resistance heaters 88, 90. Main heater bars 60 function as resistant heating elements for which dual electrical leads are shown in FIG. 3.

In the presently preferred embodiment, the mechanical hardware and the electronic circuit for operating the inventive thermal film processor comprises, by way of example: a means for preheating the film; a means for sensing the temperature of the film preheating means and for outputting a signal proportional thereto; a means for converting signals output from the means for sensing the temperature of the film preheating means into a series of corresponding preheating digital signals; a means for heating the film in the development compartment; a means for moving the film through the development compartment; a means for sensing the temperature of the film heating path in the film development compartment and for outputting a signal proportional thereto; a means for converting the signal output from the means for sensing the temperature of the film heating path into a series of corresponding heating digital signals; a means for determining when the leading and trailing ends of the film have passed through the exit of the film heating means; a digital processor means for processing the preheating digital signals and the heating digital signals so as to electronically control the temperature of the film preheating means, the temperature of the film heating path, and the speed of the means for moving the film through the development compartment; a program memory means for storing machine-readable instructions utilized by the digital processor means to carry out predetermined programmed steps; a display means, electronically connected to the digital processor means, for outputting a visual display of an indicator that the leading and trailing ends of the film have passed through the exit of the film heating means; and a means for guiding film within the cooling compartment.

Figure 4:
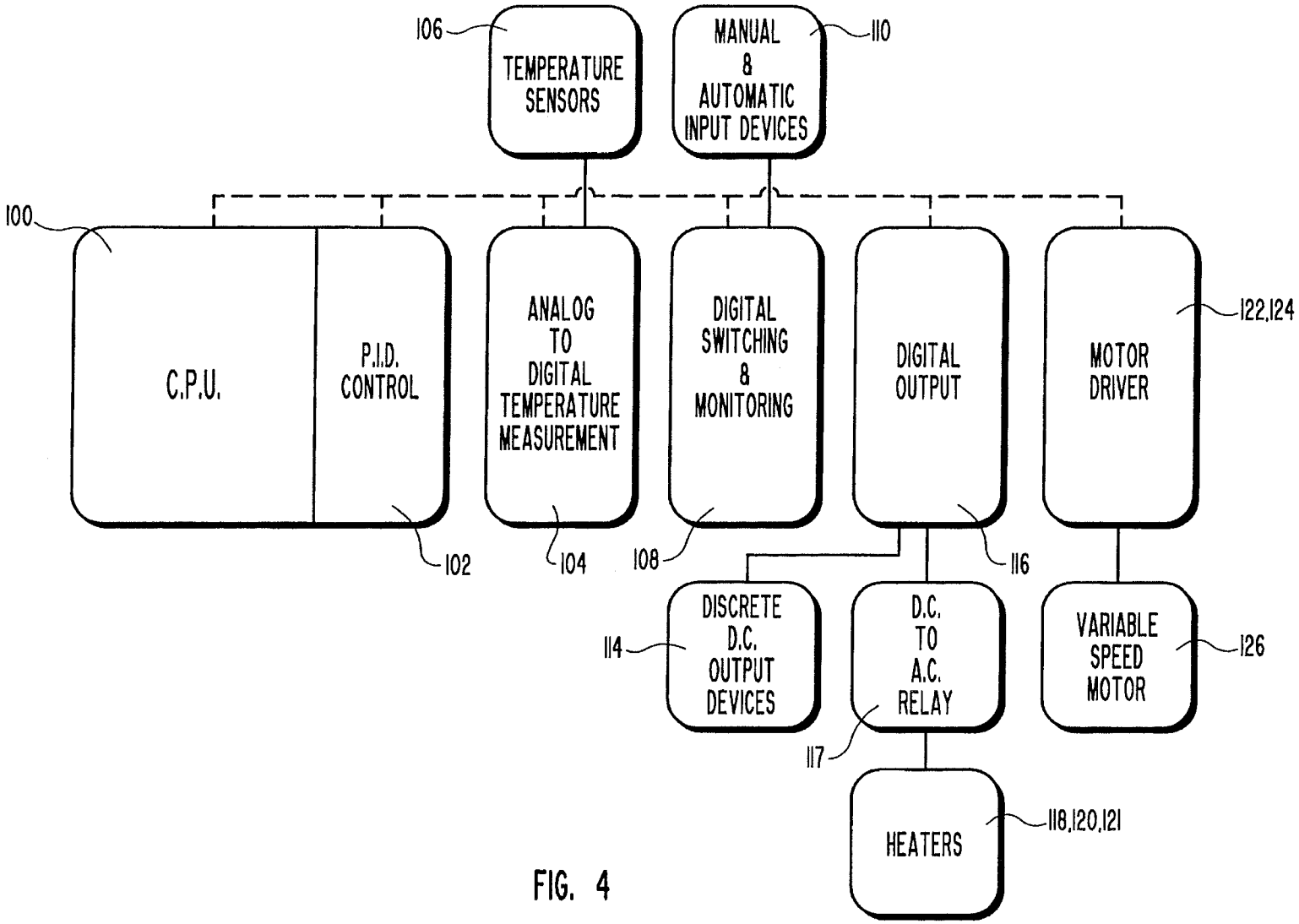
FIG. 4 is a functional block diagram which schematically illustrates the primary components of one presently preferred electronic circuit used in connection with the electronic controls of the expansion free thermal processor.

With particular reference to the preferred embodiment of the electronic circuitry as designated in FIG. 4 which shows a functional block diagram of the electronic hardware which may be used to control the processing of dry silver film 50 through expansion free thermal processor 10, a C.P.U. 100 is the central processing unit which executes software programs for controlling expansion-free thermal processor 10. A P.I.D. controller 102, which functions as a proportional, integral, and differential controller, forms a part of the digital processing functions of expansion free thermal processor 10. P.I.D. controller 100 functions according to the displacement or velocity forms of the P.I.D. equation. However, the velocity form of the P.I.D. equation is preferred, which is the following formula:

$$M(t) = k_c \left[ e(t) + \frac{1}{Ti} \int_0^t e(t)dt + Td \left( \frac{d}{dt} \right)^{e(t)} \right] + M_0$$

where:

M(t)=controller output signal $M_o$=value of controller at initialized output $K_c$=proportion gain e(t)=process variable error $T_i$=integral time constant (Reset)

$T_d$=derivative time constant (Rate)

and where:

$$e(t)=SP-PV(t)$$

PV(t)=process variable at time t

SP=set point

"SP" is intended to indicate each set point temperature at which the film in film development compartment cabinet 34 or in drive and soft rollers 56, 58 is to be maintained. "t" is the time of the process and PV(t) is the process variable which is the temperature at time t. "M(t)" is the controller output signal that is used to apply power to the various heaters within both film preheating compartment cabinet 32 and film development compartment cabinet 34 so as to achieve temperature "SP."

The P.I.D. equation is used in controllers that are available and are widely used in industrial process control operations. Controllers of this nature are also called 3-mode controllers or process controllers. The processing done by such controllers provide a proportional term, an integration term, and a derivative term. The 3-mode controller is also called a P.I.D. controller because it contains a proportional, integration, and a derivative term. The object to be obtained by the P.I.D. equation in the P.I.D. controller is to obtain a high steady-state accuracy as to temperature set point so as to maintain the transient performance of expansion-free thermal processor 10 within reasonable limits. References to the P.I.D. equation in the specification and claims, other than as specified, refer to both the displacement and velocity forms of the P.I.D. equation. Additionally, references in the specification and claims to the P.I.D. equation are intended to be broad enough include the use of at least one of the proportional, integration, or derivative terms, or in the alternative, may include the use of a combination of the proportional, integration, or derivative terms.

Block 104 of FIG. 4 shows analog to digital temperature measurement in communication with a temperature sensor box 106. Temperature sensors 106 are intended to be those associated with drive roller temperature sensor **56*a* and temperature sensors 150, 152, and 154 of film development compartment cabinet 34. Box 108 of FIG. 4 is for digital switching and monitoring. Box 108 is shown in communication with box 110 of FIG. 4 which is for manual and automatic input devices. Examples of such manual and automatic input devices are shown in FIG. 1 as the control panel on expansion-free thermal processor 10, and involve switches 22, 24, and 26. Additionally, in FIG. 2, the switching associated with ultrasonic gun 70 and ultrasonic target 72 are an example of such automatic input devices. Summarily, box 108** is a discreet input which measures whether or not various switches are open or are closed.

Box 116 is labeled "digital output" and represents the function of opening and closing DC circuits so as to turn on lights or to signal C.P.U. 100 as to the occurrence of an event. Examples of such lights are shown in FIG. 1 as lights 14, 16, 18, and 20. Box 116 is in communication with box 114 which shows discreet DC output devices, the same which are associated with the aforementioned lights 14, 16, 18, and 20. Box 117 indicates DC to AC relay and box 118, 120, and 121 is labeled heaters. Such relays for box 117 function to control the heaters in box 118, 120, and 121 which heat the film within film preheating compartment cabinet 32 and film development compartment cabinet 34.

Box 122, 124 indicates a motor driver which is in communication with box 126 as a variable speed motor. Motor driver 122, 124 and variable speed motor 126 act in conjunction with the drive train of the rollers 56, 58 shown in FIG. 3 for moving film 50 from cassette 12 shown in FIG. 1 through to processed film compartment cabinet 36 shown in FIG. 2.

Figure 5A:
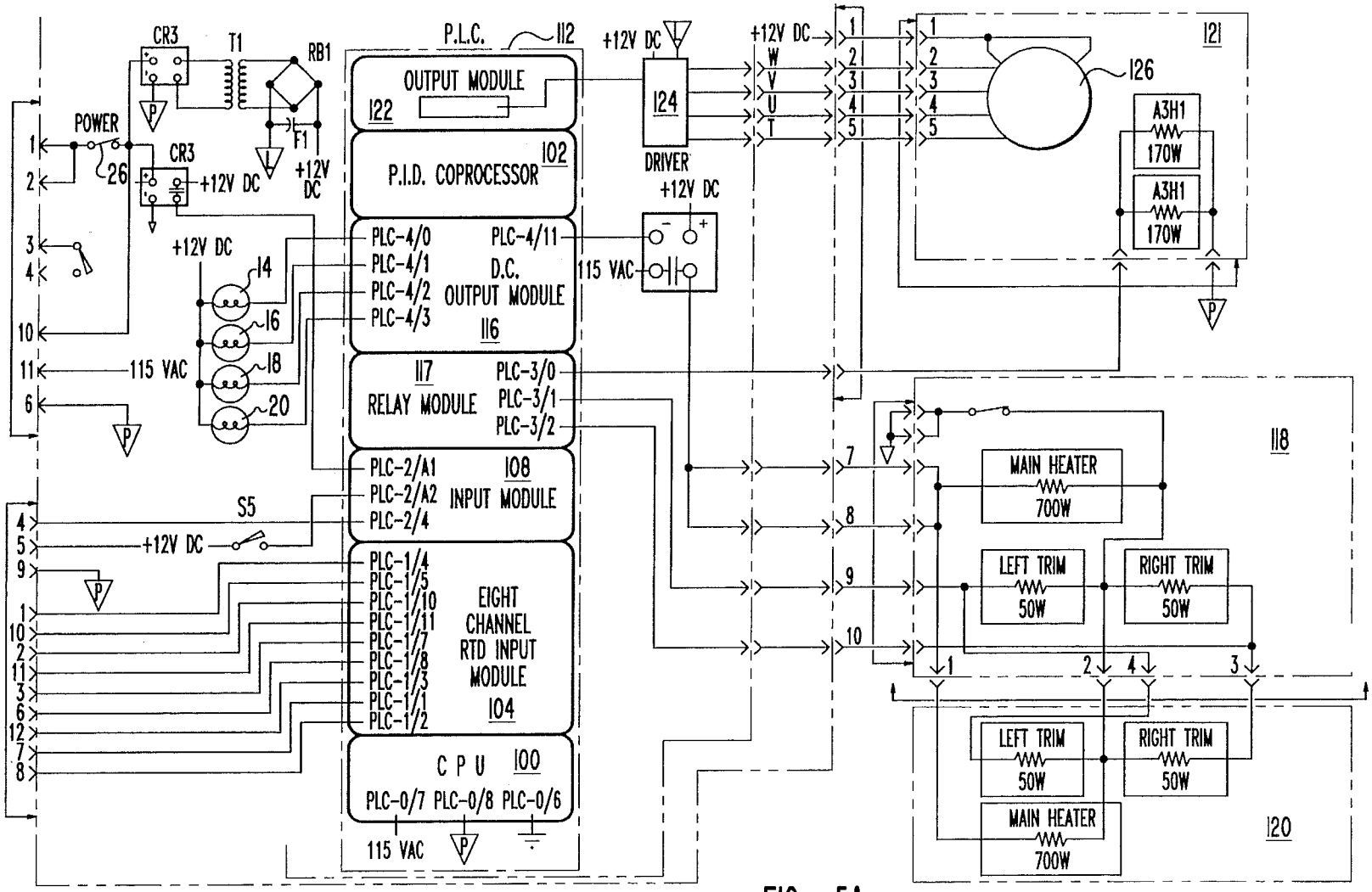
FIGS. 5A and 5B, taken together, constitute a detailed electrical schematic diagram which illustrate, as an example, the presently preferred embodiment and presently understood best mode for implementing the electronic circuitry of the system and method of the present invention for the expansion free thermal processor.
Figure 5B:
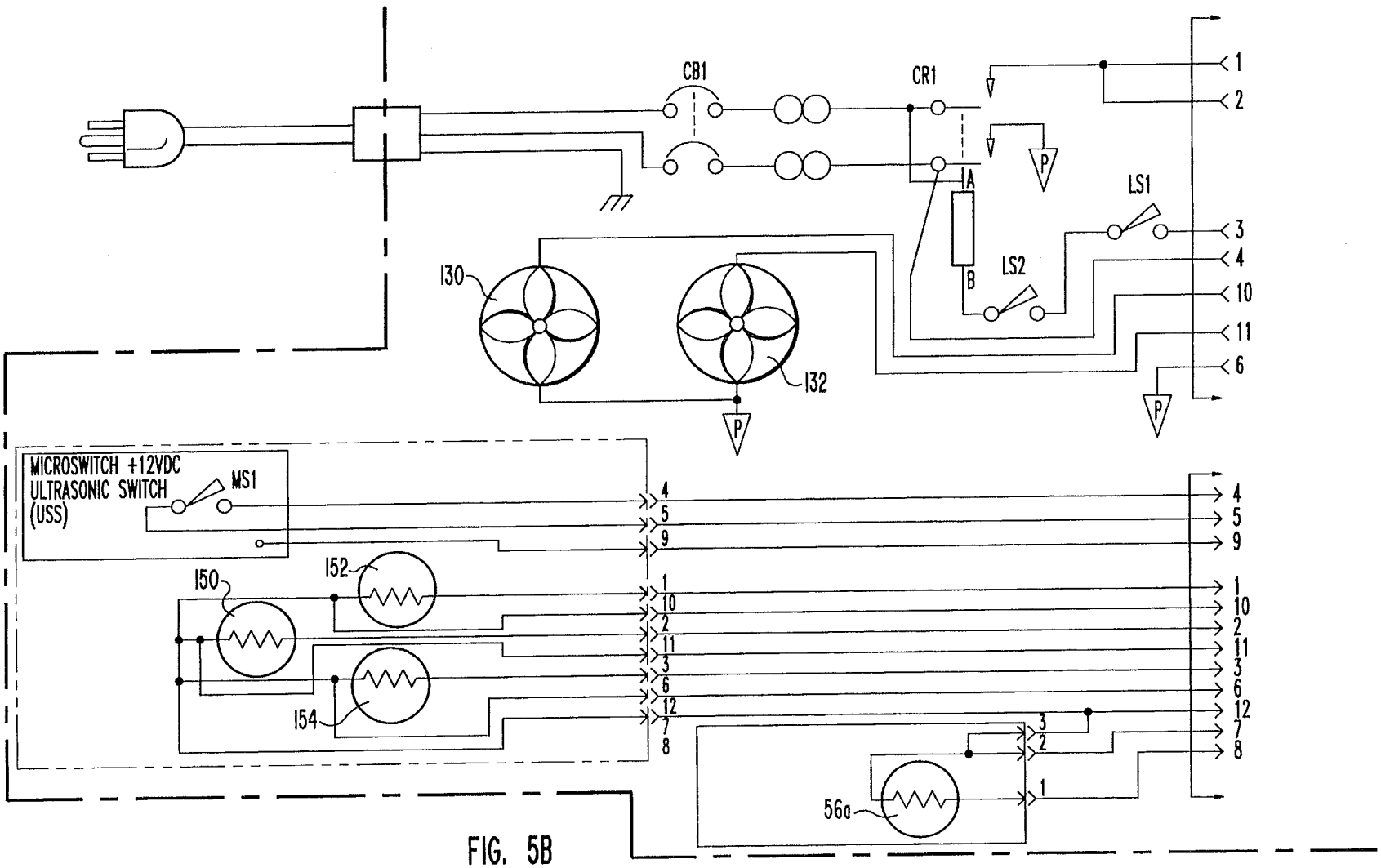

FIGS. 5A and 5B will now be referred to in which like reference numerals designate like component when compared to the functional block diagram in FIG. 4. It should be appreciated that the particular circuit components and circuit design which is illustrated in FIGS. 5A and 5B are intended merely as an example of the presently preferred embodiment and the presently understood best mode of implementing the overall functions which are represented by the block diagram of FIG. 4. FIGS. 5A and 5B illustrate in detail the electrical schematic drawing showing the components and interconnections for each of the integrated circuit components and the other circuit elements used in the implementation of the preferred embodiment. Of course, other circuit designs can be devised that would also work satisfactorily using either software driven digital processing circuit designs or hardware-based circuit designs.

With continued reference to FIGS. 4 and 5A–5B, C.P.U. 100 is shown on particularly on both FIGS. 4 and 5A. P.I.D. control 102 in FIG. 4 is shown as P.I.D. coprocessor 102 in FIG. 5A. Temperature sensors 106 in FIG. 4 relate to a main R.T.D. 152, a left trim R.T.D. 150, a right trim R.T.D. 154, and a preheater R.T.D. **56*a* shown in FIG. 5B. Main R.T.D. 152 detects the temperature of film 50 in the lower middle part of film development compartment cabinet 34. Left trim R.T.D. 150 and right trim R.T.D. 154 respectively detect temperature associated with the lower right and sides of film development compartment 34. Preheater R.T.D. 56*a* detects the temperature of drive roller 56 through drive roller temperature sensor 56*a*, as drive roller 56 is heated by drive roller heater 84, all of which are shown in FIGS. 3, 4, and 5**B.

Box 110 in FIG. 4, labeled "manual and automatic input devices" is associated with both switch S5 in FIG. 5A and micro switch MS-1 in FIG. 5B. Switch S5 in FIG. 5A places the heaters in expansion free thermal processor 10 in a standby mode. When switch S5 is closed, the respective temperatures of the heaters in expansion free thermal processor 10 are reset to a standby temperature. The standby temperature is a low temperature to which each heater may be set between the processing of successive webs of thermally processed film.

An automatic switch associated with box 110 in FIG. 4 is switch MS-1 shown in FIG. 5B. Switch MS-1 is an ultrasonic switch that uses a method of detecting film ultrasonically with sonar high frequency. The device associated with switch MS-1 is shown in FIG. 2 as ultrasonic gun 70 and ultrasonic target 72. A third switch, CR-3 is shown in FIG. 5A which is the switch that turns on the heaters in the expansion free thermal processor 10. Box 108, labeled "digital switching and monitoring" in FIG. 4, refers to box 108 labeled "input module" in FIG. 5A, and is also associated with switch S5.

Box 104 in FIG. 5A, labeled "Eight Channel R.T.D. Input Module" is a circuit for changing analog signals from the various R.T.D. inputs, shown in FIG. 5B as 150, 152, 154, and 56*a*, into a series of digital signals which can then be processed by zdigital processing circuitry.

The digital output box 116 shown in FIG. 4 is used to depict box 116 in FIG. 5A labeled "DC output module." DC output module 116 opens and closes DC circuits so as to turn on lights 14, 16, 18, and 20, or to signal C.P.U. 100 as to the occurrence of events. Lights 14, 16, 18, and 20 shown in FIG. 5A are examples of the lights which are actuated by DC output module 116. Lights 14, 16, 18, and 20 are also shown in FIGS. 1 and 2 as part of the control panel of expansion free thermal processor 10. Box 114, labeled "discrete DC output devices" in FIG. 4, corresponds to lights 14, 16, 18 and 20 in FIGS. 1, 2, and 5A.

DC to AC relay box 117 in FIG. 4 relates to relay module 117 in FIG. 5A. Relay module 117 and DC output module 116 in FIG. 5A are used to control heater boxes 118, 120 and 121 on FIG. 5A. Boxes 118, 120 and 121 are the heaters for heating the film that passes through film development compartment cabinet 34. Specifically, relay module 117 is used to control drive roller heater 84 and soft roller heater 86 shown in box 121 of FIG. 5A, and to control the left and right trim heaters in boxes 118 and 120 also shown in FIG. 5A, whereas DC output module 116 in FIG. 5A is used to control main heaters in boxes 118 and 120 of FIG. 5A. Heater box 118, 120, and 121 of FIG. 4 corresponds to boxes 118, 120 and 121 in FIG. 5A.

Output module 122 in FIG. 5A and driver 124 in FIG. 5A correspond to motor driver box 122, 124 in FIG. 4. Additionally stepper motor 126 in FIG. 5A corresponds to variable speed motor box 126 in FIG. 4. Output module 122 of FIG. 5A pulses to driver 124 in FIG. 5A which has sufficient current capacity to drive stepper motor 126.

FIGS. 5A and 5B show phantom lines which represent disconnectable, separate modules.

Ambient air can be drawn into both film preheating compartment cabinet 32 and film development compartment cabinet 34, respectively, by a preheating compartment cooling fan 132 and a development compartment cooling fan 130, both of which are shown on FIG. 5B and which create negative pressure in their respective compartments.

The purpose of expansion free thermal processor 10 is to transfer heat to film 50 for the purpose of initiating the development of the image transferred to emulsion side 54 of dry silver film 50. The general heat transfer equation for this process is:

$$Q/A = \mho (T_h - T_c)$$

where:

Q=Heat transferred, BTU/hr.

A=Area ($Ft^2$)

$\mho$=Overall heat transfer coefficient $T_h$=Hot temperature $T_c$=Cold temperature $(T_h - T_c) = \Delta T$ also $$\mho = \frac{1}{1/h_c + 1/h_r + 1/h_k}$$

where:

$h_c$=unit heat transfer coefficient for convection $h_r$=unit heat transfer coefficient for radiation $h_k$=unit heat transfer coefficient for conduction All $h_i$ coefficients are expressed in BTU/hr–ft2. In the case of expansion free thermal processor 10, $$h_k \& h_r >> h_c$$

$$\therefore \mho \approx 1/1/h_c \text{ and } Q/A \approx h_c\ (\Delta T$$

II. THE METHOD

Figure 6:
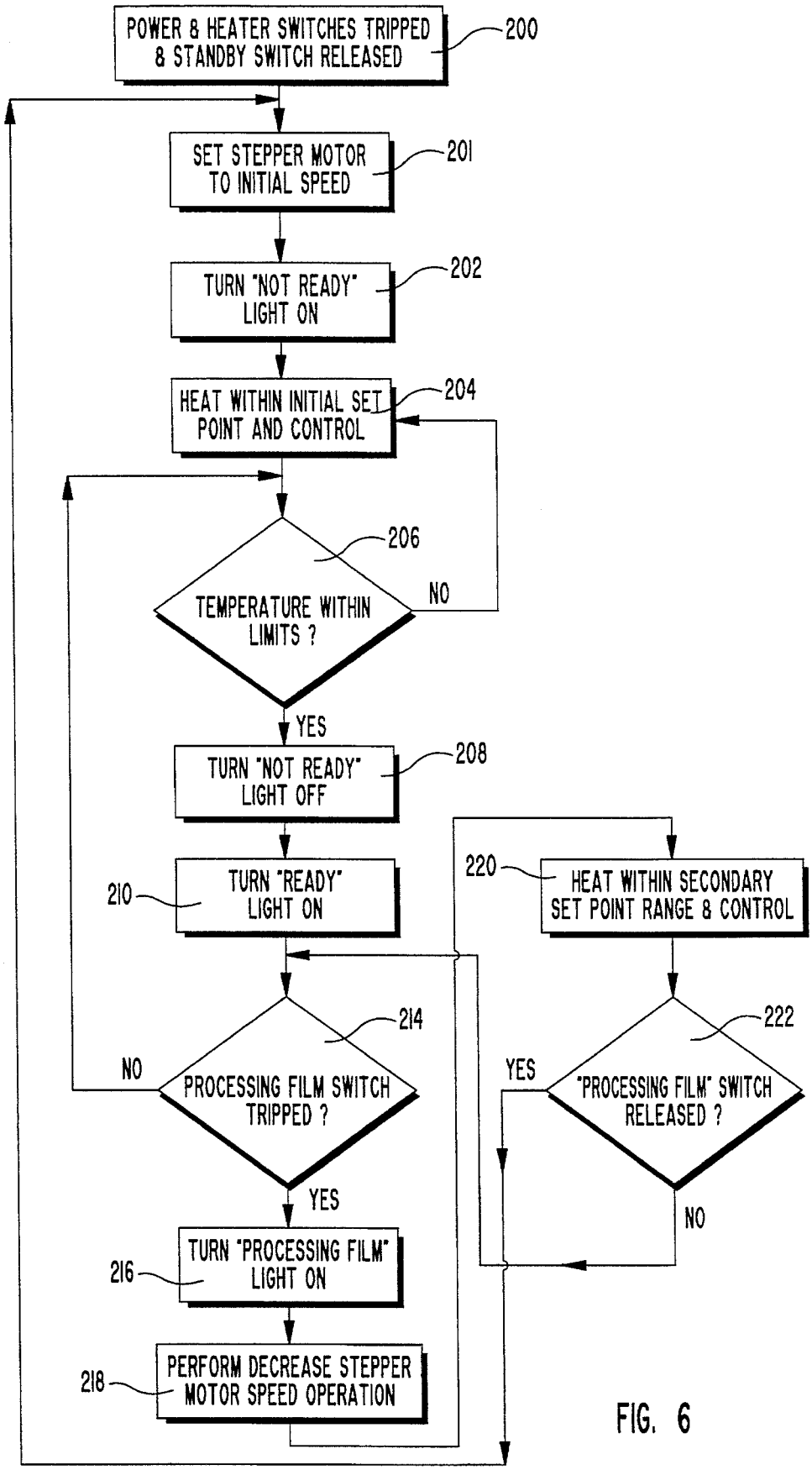
FIG. 6 illustrates a flow chart showing one presently preferred method for programming the CPU of the electronic circuitry in accordance with the method of the present invention for the expansion free thermal processor.

Attention is next turned to a detailed description of the presently preferred method by which the system of the present invention is used to develop a heat processed photographic emulsions film having a base side opposite an emulsion side and a leading end opposite a trailing end, with particular reference to FIG. 6 which illustrates one presently preferred embodiment of the instructions which may be utilized to control the electronic circuitry depicted in FIGS. 4 through 5B. As will be appreciated by those of ordinary skill in the art, and as noted above, while the system and method as described in reference to the preferred embodiments herein illustrate the system and method as implemented using state of the art digital processing design and corresponding program instructions for controlling the processor, the system and method could also be implemented and carried out using a hardware design which accomplishes the necessary electronic processing, which is thus intended to be embraced within the scope of various of the claims as set forth herein.

With particular reference to FIG. 6, when CPU 100 is turned on, the program starts as indicated at step 200 when the power-on switch 22 shown in FIG. 1 is turned on.

In order to initiate step 200, switch 22 must be on, switch 24 must be off, and switch 26 must be on. The significance of these switch settings is that switch 22 must give power to expansion free thermal processor 10, switch 24 is off which disables a lower temperature standby mode of expansion free thermal processor 10, and switch 26 must be on giving power to all the heaters shown in blocks 118, 120 and 121 of FIG. 5A.

Switch 24 is a standby switch which actuates all of the heaters in box 118, 120 and 121 of FIG. 5A into a lower temperature standby mode. In this mode, film is not being processed and the heaters are merely being maintained in a standby state while waiting for another cassette 12 to be placed on expansion free thermal processor 10 without having to go to a complete shutdown mode. In this way, the system can be kept in a near ready, or standby state pending additional processing of film.

After the on switch is tripped at step 200, which corresponds to switch 22 in FIG. 1 and switch LS1 in Figure 5B, the system proceeds to step 201 where stepper motor 126 in FIG. 5A is set to a predetermined initial speed. Then the system moves to step 202 where the not ready light is turned on. The not ready light corresponds to light 20 in FIG. 5A and in FIG. 1.

After step 202, all of the heaters in expansion free thermal processor 10 are turned on. These heaters include those in group 118, 120, and 121 of FIG. 5A. After turning on the heaters in blocks 118, 120, and 121 of FIG. 5A, the temperature of each block 118, 120, and 121 is controlled to a respective predetermined initial temperature set point range. The temperature is detected for such control via temperature sensors 56*a*, 150, 152, and 154.

At step 206, the system inquires whether all of the detected temperatures are within the respective range of the initial set point temperature. If the temperature detected at any of sensors 56*a*, 150, 152, or 154 is below the respective initial set point range, then the system returns to step 204 to control the temperature to be within the respective predetermined initial set point range. The means by which the temperature is controlled involves processing within PID co-processor 102 in FIG. 5A and the aforementioned formula for proportional, integral, and differential control of the set point temperature in conjunction with the heaters in blocks 118, 120, and 121 of FIG. 5A.

Once the system determines at step 206 that the detected temperatures are within the respective initial set point ranges, then the system moves to step 208 where the not ready light 20 in FIG. 5A and FIG. 1 is turned off. The system moves to step 210 in which the ready light 14 in FIG. 5A and FIG. 1 is turned on.

After the ready light 20 is turned on, then the system moves to step 214 in which it is determined whether the processing film switch has been tripped. The processing film switch tripped corresponds to ultrasonic switch MS1 in FIG. 5B. This switch is seen graphically in FIG. 2 as ultrasonic gun 70 and corresponding ultrasonic target 72. Thus, switch MS1 will be tripped when film 50 comes between ultrasonic gun 70 and ultrasonic target 72, thus indicating that film 50 is being processed. If the processing film switch has not been tripped, then the system returns to step 206 to again check the detected temperatures to see if they are within their respective initial set point ranges.

Once the processing film switch has been tripped at step 214, then the processing film light 16 in FIGS. 5A and 1 is turned on. Next, the system moves to Step 218 where the system performs a procedure for decreasing the speed of stepper motor 126. Stepper motor 126 is controlled through pulses that are input thereto. By way of example, and not by way of limitation, 480 pulses per second may be equivalent to 1 RPM of the output shaft of stepper motor 128. By the gearing ratio of stepper motor 126, the RPM thereof equates to a specific number of inches per minute of film speed transport through expansion free thermal processor 10. By decreasing the input pulses to stepper motor 126, stepper motor 126 can be controlled as to its speed.

CPU 100 can be programmed with a predetermined sequence of velocities for stepper motor 126. For instance, it may be possible that a constant velocity is maintained initially and then a linearly decreasing velocity thereafter is desired. Parameters for the procedure of decreasing the speed of stepper motor 126 can be input in a variety of means, such as software programming of CPU 100. Other methods for controlling stepper motor 126 are also contemplated herein and as such are considered equivalents thereof.

Once the speed of stepper motor 126 has decreased to a certain minimal level, it may be desirable to set the speed of stepper motor 126 at a constant level thereafter so that film 50 is properly exited from expansion free thermal processor 10 and will not become lodged therein. Such safety precautions as to film speed may also be programmed as instructions within CPU 100.

After the procedure of setting the speed of stepper motor 126 at step 218, the system proceeds to step 220 in which the heaters shown in blocks 118, 120 and 121 of FIG. 5A are heated to a secondary set point range and controlled thereat by a similar technique by which the initial set point range was maintained.

After the secondary set point operation at step 220, then the system moves to step 222 where a query is made as to whether the processing film switch has been released. If the processing film switch has not been released, then the system moves again to step 214 to ask again if the processing film switch has been tripped. If the processing film switch has been tripped at step 214, then the system again proceeds to step 216 in the manner described above. However, if the processing film switch has been released, then the system proceeds to step 201 which signifies that all of the film in expansion free thermal processor 10 has been processed and is ready to take on an additional film cassette 12 for processing.

III. PROCESSING CHEMICALLY DEVELOPED FILM

Figure 7:
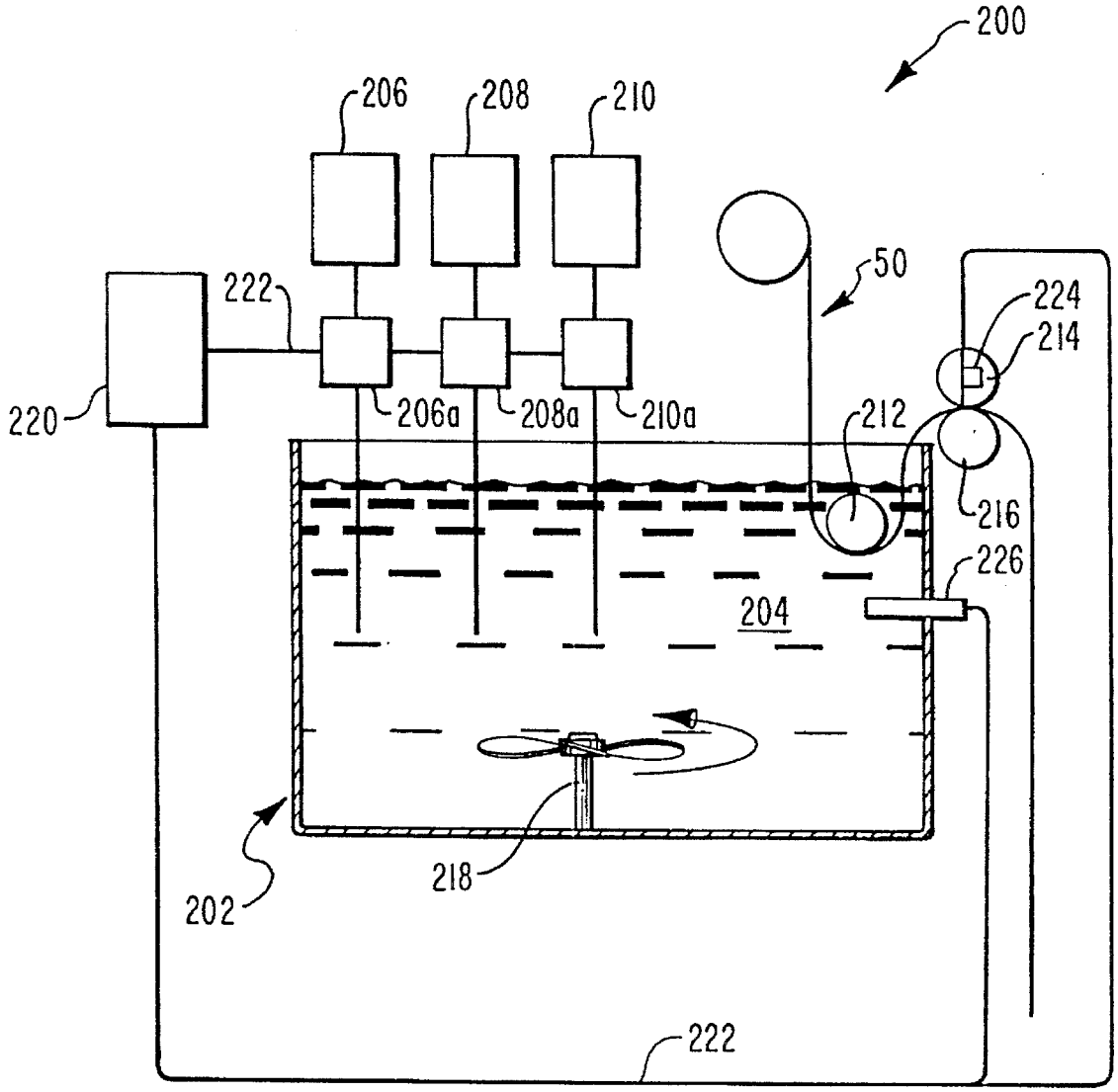
FIG. 7 depicts a system for processing chemically developed photographic film in which a controller adjusts doses of chemical activating agents into a bath of developing solution as a function of a chemical sensor electrically signalling the controller as to the need for additional doses of chemical activating agent while the controller also adjusts the speed at which the chemically developed film moves through the bath of developing solution.

FIG. 7 depicts an alternative preferred embodiment of the inventive film processing system. In this system, a chemically processed photographic film is being moved through a bath of chemical developer 204 for the purpose of developing photographic film 50. Film 50 is fed into a vat 202 containing chemical developer 204. An idler roller 212 causes film 50 to loop down into chemical developer 204 under the driven force of feeder rollers 214, 216.

Chemical developer 204 consists of several chemicals which are required for the development of film 50. First, second, and third development chemicals 206, 208, 210 are added to chemical developer 204 so as to maintain the concentration of chemical developer 204 at the desired level to properly develop film 50. Chemical developer dispensing mechanisms 206*a*, 208*a* and 210*a* respectively dispense the chemical development agent from first, second, and third development chemicals 206, 208, and 210. Chemical dispensing mechanisms 206*a*, 208*a*, and 210*a* are controlled via a controller 220 which is in communication therewith via a wiring harness 222. A mixing propeller 218 is used to blend and mix first, second, and third development chemicals 206, 208, and 210 into solution in chemical developer 204.

A concentration sensor 226 detects the relative concentrations of first second, and third development chemicals 206, 208, and 210, which concentrations are communicated to controller 220 via wiring harness 222 for subsequent digitizing and processing by controller 220. As in the thermally developed film described in Sections I and II herein, a proportional, integral, and derivative equation is used with the digitized concentrations to control chemical developer dispensing mechanisms 206*a*, 208*a*, and 210*a* so as to maintain the proper concentration of chemical developing agents within chemical developer 204. Also, as in the previously described thermally developed film, the speed with which film 50 travels through chemical developer 204 is decreased progressively so as to compensate for a decrease in the concentration of developer coming in contact with film 50 and allow for a more uniform development density along the length of film 50. As drive rollers 214, 216 feed film 50 into chemical developer 204, the necessary chemicals to maintain a desired concentration are fed into chemical developer bath 204 and are mixed by a propeller 218. As a means of example and not as a means of limitation, first, second, and third development chemicals 206, 208, and 210 are required to maintain the desired development concentration necessary to process and develop film 50. Each chemical developer dispensing mechanism 206*a*, 208*a*, and 210*a* has a chute extending therefrom into which the respective first, second, and third development chemicals 206, 208, and 210 are injected through into vat 202 to be mixed into chemical developer 204 via propeller 218.

Controller 220 contains the necessary electronic circuitry to control chemical developer dispensing mechanisms 206*a*, 208*a*, and 210*a*, as well as a stepper motor 224 which is used to drive feeder rollers 214 and 216. Similar electronic circuitry to the previously described thermal film development system can be used in the chemical film development.

Figure 8:
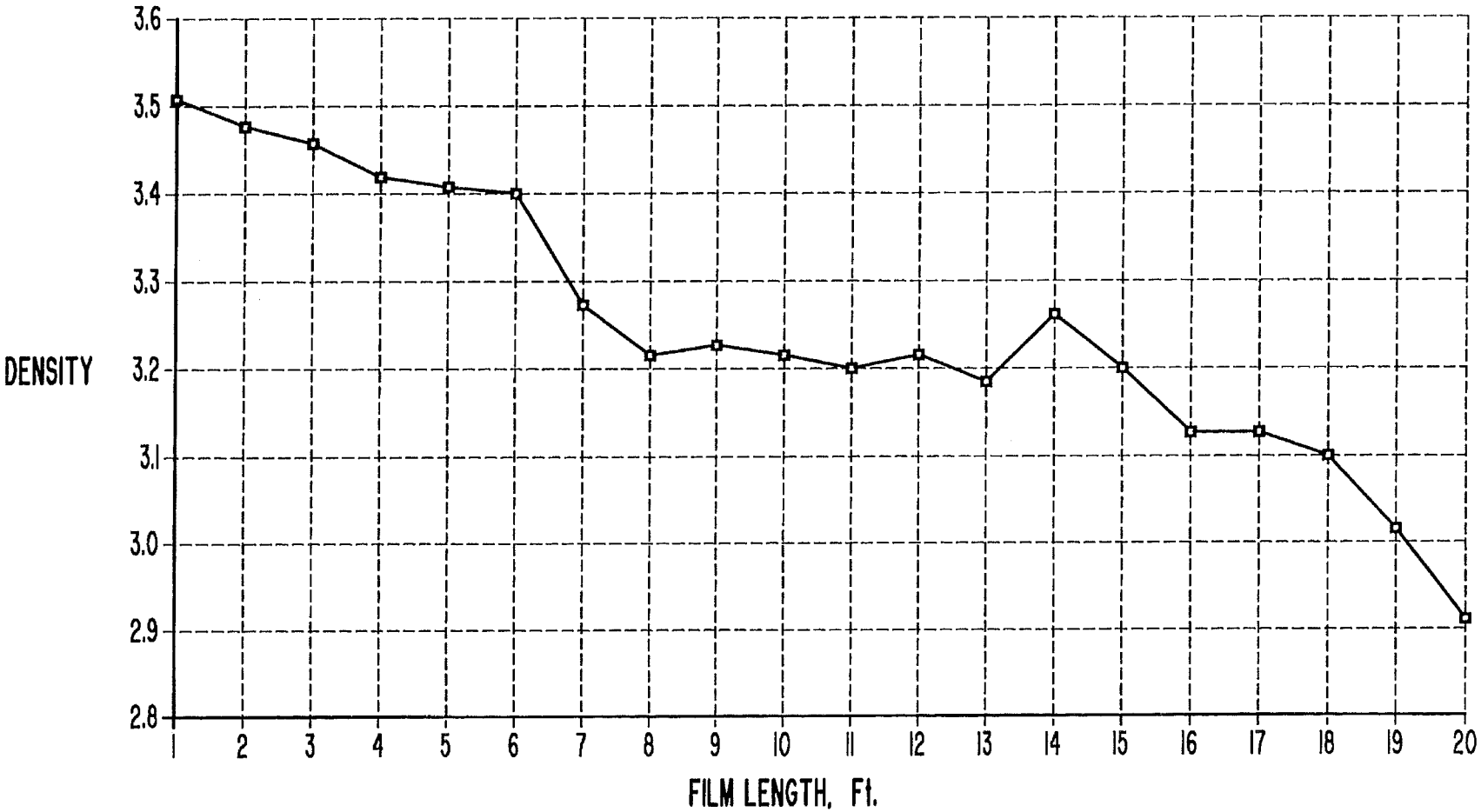
FIG. 8 (PRIOR ART)
FIG. 8 is a depiction of the decline in web development density as a function of the length of the film developed in a system in which the film being processed travels therethrough at a constant speed throughout the length of the web of the film. This graph is representative of chemical or thermal film processors that are uncompensated for film traveling speed.

FIG. 8 shows a graphic representation of web development density with respect to film length. Web development density indicates the quality with which development has been performed, where a high number indicates a greater quality than a low number. This graph depicts that as the length of film being developed goes up, then the quality of the web development density goes down. This graph represents a film processor which maintains proper set points for process variables PV(t) without decreasing the speed of the film being processed as film development progresses.

Figure 9:
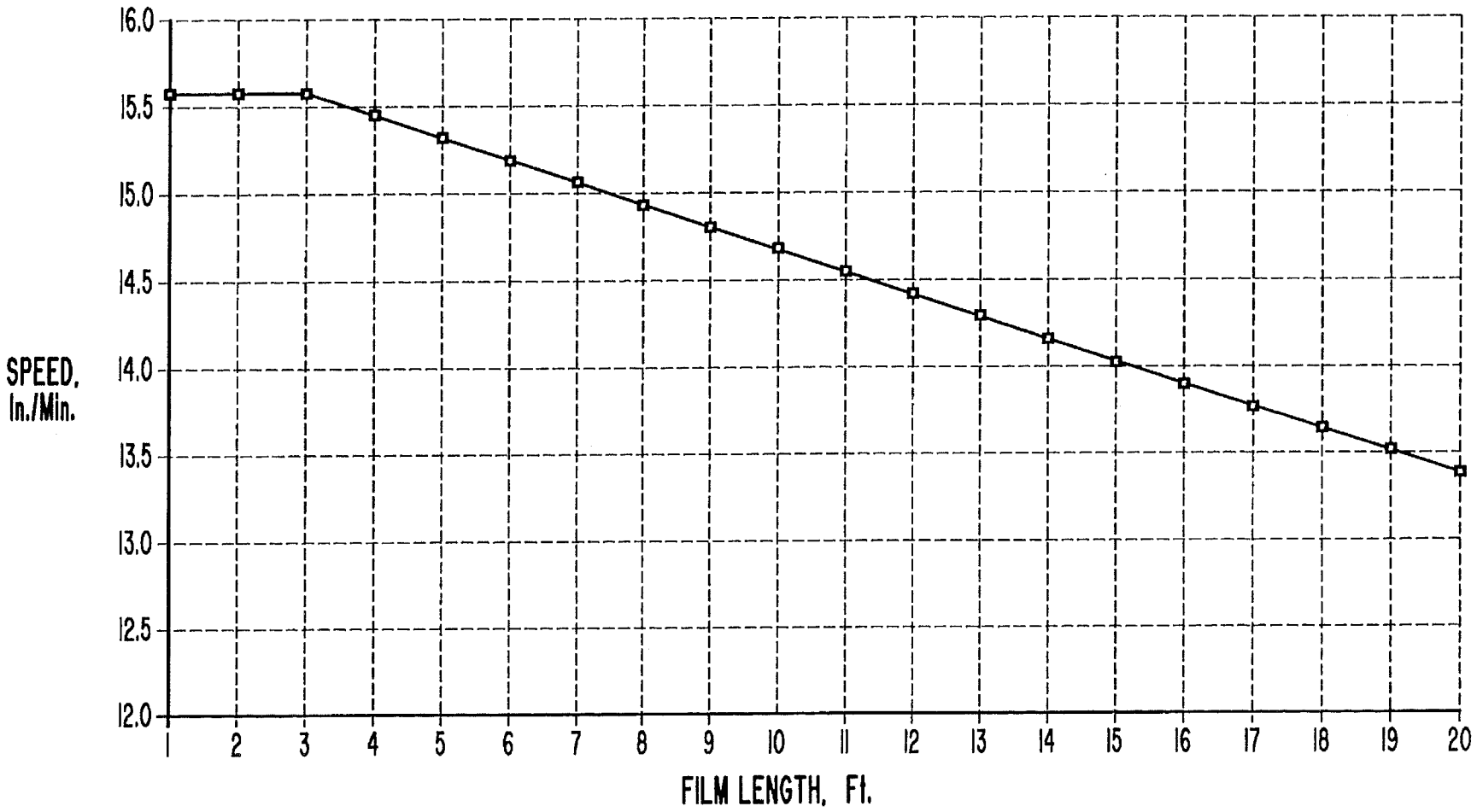
FIG. 9 depicts the speed of film as a function of the length thereof when properly compensated according to the method of the present invention, such that the film speed declines with increasing length of film. This graph is representative of both chemical and thermal film processors according to the present inventive method.

FIG. 9 shows a properly compensated film processor in which speed is decreased as film length increases.

Figure 10:
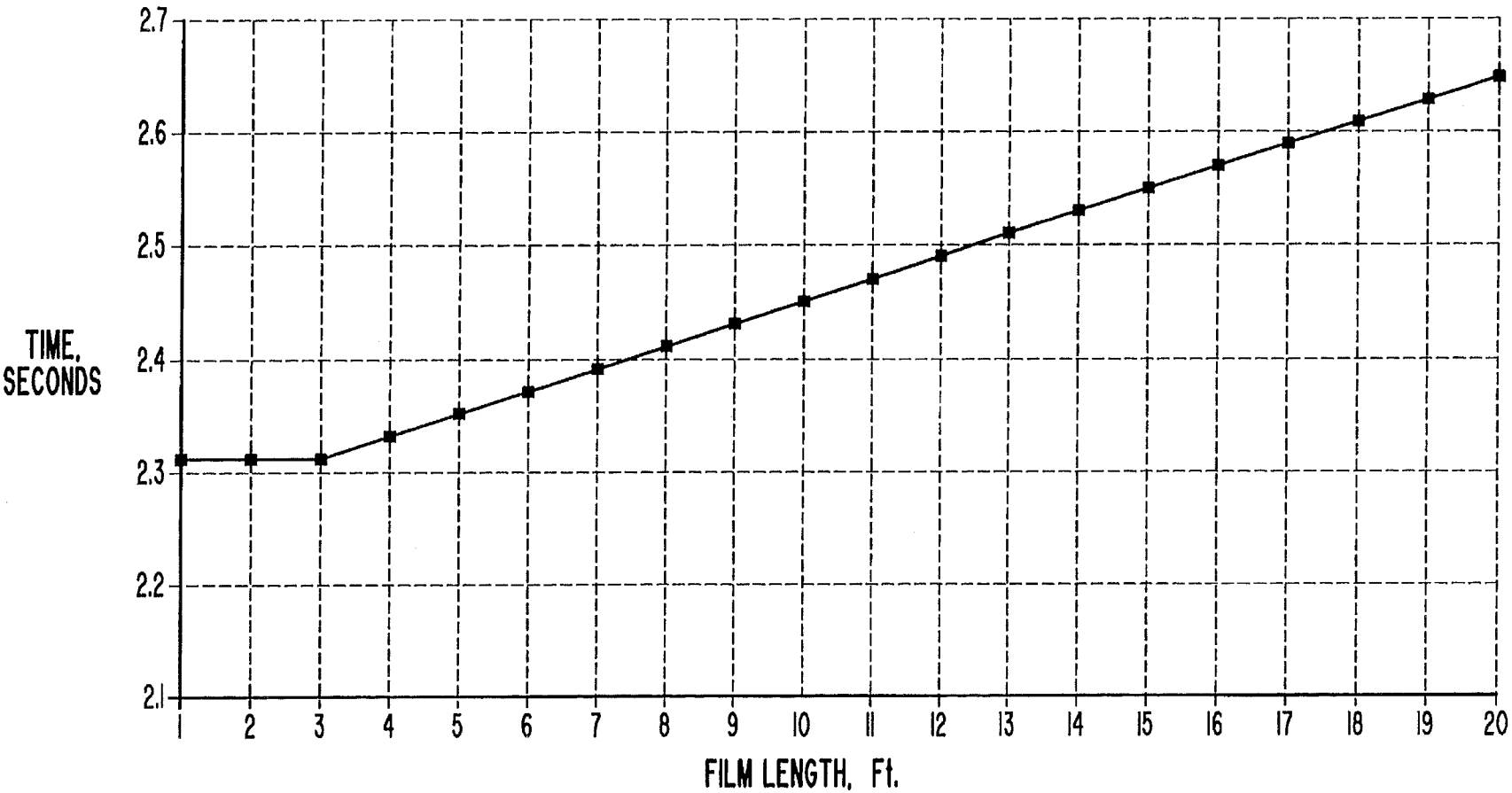
FIG. 10 is coordinated with FIG. 8 and shows the length of time to process one foot of film with increasing length of the film being processed, where the time to process a length of film increases with increasing length of film.

FIG. 10 shows the time versus film length of a properly compensated film processor for process variable PV(t)in which time goes up as film length increases. Thus, a foot of film requires a greater development time with increasing web lengths and a longer length of film will require a greater amount of time through the film processor in order to be properly developed.

Figure 11:
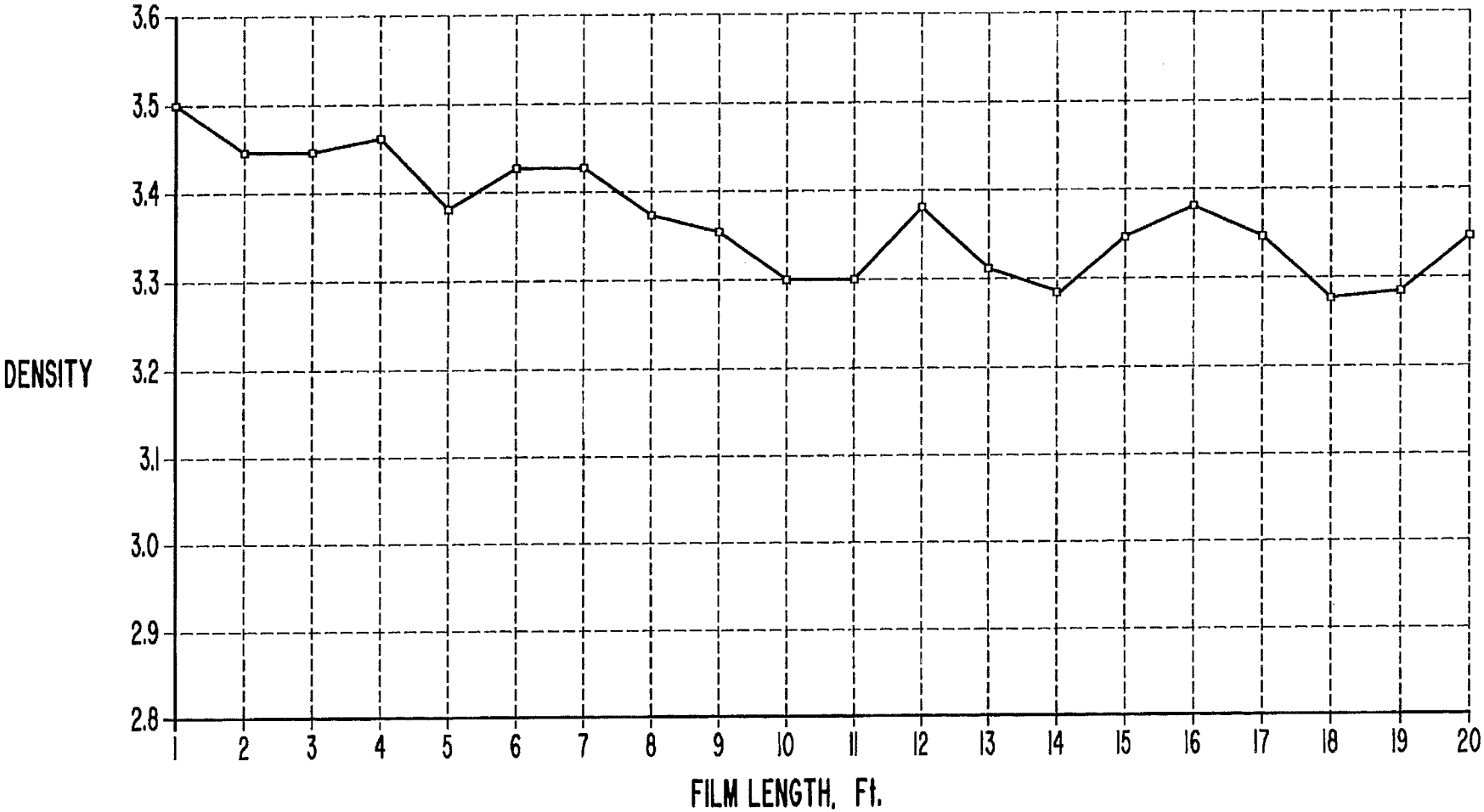
FIG. 11 depicts the web development density as a function of the film length where the film is processed using the temperature or activating agent concentration and speed compensation techniques of the method and system of the present invention for both thermal and chemical film processing

FIG. 11 shows the quality of the web development density over a 20 foot length of film in which the quality of film development density varies between 3.5 and approximately 3.3 for a properly compensated process variable PV(t) with progressively decreased filmspeed as the length of the film that has been processed incresaes. It is desirable that the film web development density be maintained above 3.2 in order to give a quality development process for the film.

It will be appreciated that CPU 100 of FIG. 5A, which is a SIMATIC PLC CPU Model TI435DC1 as identified in Table I, could be programmed so as to implement the above-described method in Section II using any one of a variety of different programming languages and programming techniques. Attached hereto as Appendix A is one such program which was prepared for use with the SIMATIC PLC CPU with a TiSoft compiler version 2.2 and the circuit configuration as illustrated in FIGS. 5A and 5B. The attached program comprises a listing of source code for the SIMATIC PLC CPU.

In the presently preferred embodiments, the digital processor means may alternatively be a general purpose microcomputer such as an IBM Personal Computer or an equivalent device. Alternatively, it may be desirable to utilize a more powerful microcomputer or to devise a microprocessor-based apparatus specifically designed to carry out the data processing functions incidental to this invention.

Importantly, the hardware which embodies the digital processor means of the present invention must function to perform the operations essential to the invention and any device capable of performing the necessary operations should be considered an equivalent of the digital processor means. As will be appreciated, advances in the art of modern electronic devices may allow the digital processor means to carry out internally many of the functions carried out by hardware illustrated in FIG. 5A and 5B as being independent of the digital processor means. The practical considerations of cost and performance of the system will generally determine the delegation of functions between the digital processor means and the remaining dedicated hardware.

As can be seen in FIGS. 5A and 5B, in the presently preferred embodiment CPU 100 is interconnected with visual display lights 14, 16, 18, and 20 which perform the function of a display means. As intended herein, the display means may be any device which enables the operating personnel to observe the status of the film process as calculated by the digital processor means. Thus, the display means may be a device such as a cathode ray tube, an LCD display, a chart recorder, or any other device performing a similar function.

The method of the present invention is carried out under the control of a program resident in the microcomputer. Those skilled in the art, using the information given herein, will readily be able to assemble the necessary hardware, either by purchasing it off-the-shelf or by fabricating it and properly programming the microcomputer in either a low level or a high level programming language. While it is desirable to utilize clock rates that are as high as possible, and as many bits as possible in the A/D converters described herein, the application of the embodiment and economic considerations will allow one skilled in the art to choose appropriate hardware for interfacing the microcomputer with the remainder of the embodiment. Also, it should be understood that for reasons of simplifying the diagrams some necessary structures are not explicitly shown in the Figures, but are provided in actuality using conventional techniques and apparatus.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

TABLE 1

| QUANTITY | PART NUMBER | DESCRIPTION |
|---|---|---|
| 1 | TI453DC1 | SIMATIC PLC CPU |
| 1 | 062-00126 | CTI 8 Channel RTD Module |
| 1 | TIU-55N | SIMATIC 12-24 VAC/VDC Input Module |
| 1 | TIU-01T | SIMATIC 8 Point Relay Output Module |
| 1 | TIU-15T | SIMATIC 24 VDC Output Module |
| 1 | 405-16PID | Facts Engineering PID Coprocessor |
| 1 | TIU-01PM | SIMATIC Single-axis Position Controller |
| 1 | 945-F4Y-2D-001 | MicroSwitch Sensor |

TABLE 1-continued

| QUANTITY | PART NUMBER | DESCRIPTION |
|---|---|---|
| 4 | F3141 | 100 Ohm Platinum RTD's |
| 1 | 6VS1 | 120 VAC Line Filter |
| 1 | DA2500 | Motorola Rectifier Bridge |
| 1 | P8555 | 4 Amp 14 V Power Transformer |
| 2 | EPD-92515-HST | INDEC Cooling Fan |
| 1 | TX2AP0-U00-WHZ | Heinemann Circuit Breaker |
| 1 | W389-ACX-9 | Magnecraft Relay |
| 4 | 03-09-1122 | Molex Connector |
| 4 | 03-09-2122 | Molex Connector |
| 2 | 02-09-1022 | Molex Connector |
| 2 | 03-09-2021 | Molex Connector |
| 2 | 03-09-1121 | Molex Connector |
| 2 | 02-09-2121 | Molex Connector |
| 1 | EPC-013 | Hurst Stepper Motor Control |
| 1 | PBS3208-009 | Hurst Stepper Motor |
| 1 | TRD11010WL | Rocker Switch |
| 2 | 1500-113-071 | Rocker Switch |
| 1 | 36D103UO25R3C | Capacitor |
| 2 | 5SR-24DD25 | Solid State Relay |
| 2 | FSP221WM | 700 W Bar Heater |
| 4 | C2A4 | 50 W Cartridge Heater |
| 2 | C4A4 | 170 W Cartridge Heater |
| 1 | 745-VV-10 | Light |
| 1 | 745-VV-20 | Light |
| 1 | 745-VV-30 | Light |
| 1 | 745-VV-00 | Light |
| 4 | 10-541 | Terminal Strip |

What is claimed and desired to be secured by United States Letters Patent is:

1. A method for developing a heat processed type photographic emulsions film having a base side opposite an emulsions side, and a leading end opposite a trailing end, the method comprising the steps of:

sensing a signal output from a temperature sensing means for sensing the temperature within a development compartment, the signal being proportional to the temperature of the development compartment;

converting the signal output from the means for sensing the temperature of the development compartment into a series of corresponding digital signals for the temperature of the development compartment;

comparing the series of corresponding digital signals for the temperature of the development compartment with a predetermined development compartment temperature range;

deriving a controller output signal for the development compartment as a function of time, the predetermined development compartment temperature range, and the series of corresponding digital signals for the temperature of the development compartment using the PID equation;

applying power to a means for heating the development compartment proportional to the derived controller output signal for the development compartment while the temperature of the development compartment is below the predetermined development compartment temperature range, and removing power applied to the means for heating the development compartment proportional to the derived controller output signal for the development compartment while the temperature of the development compartment is above the predetermined development compartment temperature range;

moving the film at a predetermined decreasing rate sequence from an initial film moving rate into and through the development compartment, the portion of the film within the development compartment being free from contact within the development compartment;

moving the film into a cooling compartment at an entrance of the cooling compartment immediately after the development compartment; and cooling the portion of the film in the cooling compartment to a temperature substantially below the predetermined development compartment temperature range.

2. The method as defined in claim 1, wherein prior to said step of sensing a signal output from a temperature sensing means for sensing the temperature within a development compartment, there is performed a film preheating routine comprising the steps of:

sensing a signal output from a temperature sensing means for sensing the temperature of a means for preheating the film, said signal being proportional to the temperature of the film preheating means;

converting the signal output from the means for sensing the temperature of the film preheating means into a series of corresponding digital signals for the temperature of the film preheating means;

comparing the series of corresponding digital signals for the temperature of the film preheating means with a predetermined preheating temperature range;

deriving a controller output signal for the film preheating means as a function of time, the predetermined preheating temperature range, and the series of corresponding digital signals for the temperature of the film preheating means using the PID equation; and applying power to the film preheating means proportional to the derived controller output signal for the film preheating means while the temperature of the film preheating means is below the predetermined preheating temperature range, and removing power applied to the film preheating means proportional to the derived controller output signal for the film preheating means while the temperature of the film preheating means is above the predetermined preheating temperature range;

moving the film at said predetermined decreasing rate sequence from said initial film moving rate from a means for storing the film into the means for preheating the film; and moving the film through the means for preheating the film to an entrance of the development compartment.

3. A method for developing a heat processed type photographic emulsions film having a base side opposite an emulsions side, and a leading end opposite a trailing end, the method comprising the steps of:

performing a temperature and rate setting routine comprising the steps of:

sensing a signal output from a temperature sensing means, the temperature sensing means sensing the temperature of a means for preheating the film, said signal being proportional to the temperature of the film preheating means;

converting the signal output from the means for sensing the temperature of the film preheating means into a series of corresponding digital signals for the temperature of the film preheating means;

comparing the series of corresponding digital signals for the temperature of the film preheating means with a predetermined preheating temperature range;

deriving a controller output signal for the film preheating means as a function of time, the predetermined preheating temperature range, and the series of corresponding digital signals for the temperature of the film preheating means using the PID equation;

applying power to the film preheating means proportional to the derived controller output signal for the film preheating means while the temperature of the film preheating means is below the predetermined preheating temperature range, and removing power applied to the film preheating means proportional to the derived controller output signal for the film preheating means while the temperature of the film preheating means is above the predetermined preheating temperature range;

sensing a signal output from a temperature sensing means for sensing the temperature within a development compartment, the signal being proportional to the temperature of the development compartment;

converting the signal output from the means for sensing the temperature of the development compartment into a series of corresponding digital signals for the temperature of the development compartment;

comparing the series of corresponding digital signals for the temperature of the development compartment with a predetermined development compartment temperature range;

deriving a controller output signal for the development compartment as a function of time, the predetermined development compartment temperature range, and the series of corresponding digital signals for the temperature of the development compartment using the PID equation;

applying power to a means for heating the development compartment proportional to the derived controller output signal for the development compartment while the temperature of the development compartment is below the predetermined development compartment temperature range, and removing power applied to the means for heating the development compartment proportional to the derived controller output signal for the development compartment while the temperature of development compartment is above the predetermined development compartment temperature range;

setting a means for moving film at a predetermined decreasing rate sequence from an initial rate;

moving the leading end of the film into the means for preheating the film and into the means for moving film;

moving the film through the means for preheating the film with the film moving means;

moving the leading end of the film under the force of gravity vertically downwards into and through the development compartment, the portion of the film within the development compartment being free from contact within the development compartment; and moving the film under the force of gravity vertically downwards into a cooling compartment at an entrance of the cooling compartment immediately after the development compartment;

cooling the portion of the film in the cooling compartment substantially to a temperature substantially below the predetermined development compartment temperature range.

4. A method for developing a heat processed type photographic emulsions film having a base side opposite an emulsions side, and a leading end opposite a trailing end, the method comprising the steps of:

performing an initial temperature and rate setting routine comprising the steps of:

sensing a signal output from a temperature sensing means, the temperature sensing means sensing the temperature of a means for preheating the film, said signal being proportional to the temperature of the film preheating means;

converting the signal output from the means for sensing the temperature of the film preheating means into a series of corresponding digital signals for the temperature of the film preheating means;

comparing the series of corresponding digital signals for the temperature of the film preheating means with a predetermined initial preheating temperature range;

deriving a controller output signal for the film preheating means as a function of time, the predetermined initial preheating temperature range, and the series of corresponding digital signals for the temperature of the film preheating means using the PID equation;

applying power to the film preheating means proportional to the derived controller output signal for the film preheating means while the temperature of the film preheating means is below the predetermined initial preheating temperature range, and removing power applied to the film preheating means proportional to the derived controller output signal for the film preheating means while the temperature of the film preheating means is above the predetermined initial preheating temperature range;

sensing a signal output from a temperature sensing means for sensing the temperature within a development compartment, the signal being proportional to the temperature of the development compartment;

converting the signal output from the means for sensing the temperature of the development compartment into a series of corresponding digital signals for the temperature of the development compartment;

comparing the series of corresponding digital signals for the temperature of the development compartment with a predetermined initial development compartment temperature range;

deriving a controller output signal for the development compartment as a function of time, the predetermined initial development compartment temperature range, and the series of corresponding digital signals for the temperature of the development compartment using the PID equation;

applying power to a means for heating the development compartment proportional to the derived controller output signal for the development compartment while the temperature of the development compartment is below the predetermined initial development compartment temperature range, and removing power applied to the means for heating the development compartment proportional to the derived controller output signal for the development compartment while the temperature of development compartment is above the predetermined initial development compartment temperature range;

setting a means for moving film at a constant initial rate;

moving the leading end of the film into the means for preheating the film and into the means for moving film;

moving the film through the means for preheating the film with the film moving means;

moving the leading end of the film under the force of gravity vertically downwards into and through the development compartment, the portion of the film within the development compartment being free from contact within the development compartment; and moving the film under the force of gravity vertically downwards into a cooling compartment at an entrance of the cooling compartment immediately after the development compartment, the portion of the film entering the cooling compartment being free from contact at the entrance of the cooling compartment;

cooling the portion of the film in the cooling compartment substantially to a temperature substantially below the predetermined initial development compartment temperature range;

performing a secondary temperature and rate setting routine when the leading end of the film has passed through the development compartment and comprising the steps of:

sensing a signal output from the temperature sensing means for sensing the temperature of the film preheating means, said signal being proportional to the temperature of the film preheating means;

converting the signal output from the means for sensing the temperature of the film preheating means into a series of corresponding digital signals for the temperature of the film preheating means;

comparing the series of corresponding digital signals for the temperature of the film preheating means with a predetermined secondary preheating temperature range;

deriving a controller output signal for the film preheating means as a function of time, the predetermined secondary preheating temperature range, and the series of corresponding digital signals for the temperature of the film preheating means using the PID equation;

applying power to the film preheating means as a function of the derived controller output signal for the film preheating means while the temperature of the film preheating means is below the predetermined secondary preheating temperature range, and removing power applied to the film preheating means as a function of the derived controller output signal for the film preheating means while the temperature of the film preheating means is above the predetermined secondary preheating temperature range;

sensing a signal output from the temperature sensing means for sensing the temperature within the development compartment, the signal being proportional to the temperature of the development compartment;

converting the signal output from the means for sensing the temperature of the development compartment into a series of corresponding digital signals for the temperature of the development compartment;

comparing the series of corresponding digital signals for the temperature of the development compartment with a predetermined secondary development compartment temperature range;

deriving a controller output signal for the development compartment as a function of time, the predetermined secondary development compartment temperature range, and the series of corresponding digital signals for the temperature of the development compartment using the PID equation;

applying power to the means for heating the development compartment as a function of the derived controller output signal for the development compartment while the temperature of the development compartment is below the predetermined secondary development compartment temperature range, and removing power applied to the means for heating the development compartment as a function of the derived controller output signal for the development compartment while the temperature of development compartment is above the predetermined secondary development compartment temperature range; and moving the film at a predetermined decreasing rate sequence from the constant initial rate after the leading end of the film passes through the development compartment

5. The method as defined in claim 4, further comprising the step of moving the film at a constant final moving rate with the film moving means when the moving rate of the film decreases to the final moving rate.

6. The method as defined in claim 5, further comprising the step of performing the initial temperature and rate setting routine after the trailing end of the film has passed through the development compartment.

7. The method as defined in claim 4, further comprising the step of providing air circulation in the development compartment by a means for air circulation.

8. A method as defined in claim 7, wherein said air circulation step further comprises the step of providing a moving cushion of air against both the base and emulsion sides of the film by said air circulation means.

9. A method as defined in claim 4, further comprising the steps of:

providing air circulation in the development compartment by means for air circulation; and providing a moving cushion of air against both the base and emulsion sides of the film by said air circulation means.

10. A method as defined in claim 7, wherein said means for air circulation is a series of rotating soft foam rollers.

11. The method as defined in claim 7, wherein said air movement means comprises:

at least one roller, not in contact with the film in the development compartment, the surface of said at least one roller rotating at a surface velocity greater than the velocity of the portion of the film moving through the development compartment.

12. A method as defined in claim 4, wherein each step performed by said means for moving the film and by said means for preheating the film further include the step of:

applying pressure and temperature simultaneously to the base and emulsion sides of the film with a means for applying temperature and pressure to remove wrinkling and curling therefrom.

13. The method as defined in claim 12, wherein said means for applying temperature and pressure is a pair of heated rollers having a nip contact therebetween at which the film is pressurized and preheated during the movement of the film through the nip contact.

14. A method as defined in claim 13, wherein one of the pair of rollers contacts the base side of the film and is harder than the other roller of said pair of rollers, and the other roller of said pair of rollers contacts the emulsion side of the film.

15. A method as defined in claim 13, wherein the pair of rollers rotates in opposite directions, the friction of the contact nip on the film causing the film to be moved therethrough.

16. A method as defined in claim 15, wherein the pair of rollers orient the film exiting from the contact nip in a vertically downward direction, the film exiting the film preheating means and moving through the development compartment in a vertically downward direction under the force of gravity.

17. A method as defined in claim 4, wherein the step of cooling the portion of the film in the cooling compartment further comprises the step of:

guiding the film through at least a portion of the cooling compartment with a means for guiding film.

18. A method as defined in claim 17, wherein the means for guiding film is in contact with only the base side of the portion of the film in the cooling compartment.

* * * * *